US009186881B2

(12) United States Patent
Vinnay et al.

(10) Patent No.: US 9,186,881 B2
(45) Date of Patent: Nov. 17, 2015

(54) THERMALLY ISOLATED LIQUID SUPPLY FOR WEB MOISTENING

(75) Inventors: Thomas Vinnay, Nordrach (DE); Jens Froehlich, Weil am Rhein (DE); Kui-Chiu Kwok, Gurnee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 869 days.

(21) Appl. No.: 12/430,809

(22) Filed: Apr. 27, 2009

(65) Prior Publication Data

US 2010/0224665 A1 Sep. 9, 2010

Related U.S. Application Data

(63) Continuation-in-part of application No. 12/400,146, filed on Mar. 9, 2009.

(51) Int. Cl.

| | |
|---|---|
| ***B05B 7/06*** | (2006.01) |
| ***B41F 23/02*** | (2006.01) |
| ***D21G 7/00*** | (2006.01) |
| ***D21G 1/00*** | (2006.01) |
| ***B05B 7/08*** | (2006.01) |
| *B05C 11/10* | (2006.01) |
| *B05C 5/02* | (2006.01) |
| *B05B 1/04* | (2006.01) |
| *B05B 5/14* | (2006.01) |

(52) U.S. Cl.

CPC ..... *B41F 23/02* (2013.01); *B05B 7/067* (2013.01); *B05B 7/08* (2013.01); *B05B 7/0815* (2013.01); *B05B 7/0861* (2013.01); *B05B 7/0884* (2013.01); *D21G 1/0093* (2013.01); *D21G 7/00* (2013.01); *B05B 1/04* (2013.01); *B05B 5/14* (2013.01); *B05C 5/027* (2013.01); *B05C 11/1044* (2013.01)

(58) Field of Classification Search

CPC ..... B05B 7/0815; B05B 7/0884; B05B 7/08; B05B 5/14; B05B 1/14; B05B 15/069; B05B 7/066; B05B 7/0441; B05B 7/0677; B41F 23/02; D21G 7/00; D21G 1/0093; B41M 1/06; B05C 11/1044; B05C 5/027

USPC ..... 118/313, 314; 239/397, 548, 550

See application file for complete search history.

(56) References Cited

U.S. PATENT DOCUMENTS

| | | | |
|---|---|---|---|
| 2,070,696 | A | 2/1937 | Tracy |
| 3,028,102 | A | 4/1962 | Davies et al. |
| 3,195,819 | A | 7/1965 | Watanabe |

(Continued)

FOREIGN PATENT DOCUMENTS

| | | |
|---|---|---|
| AU | 462977 | 12/1973 |
| AU | 462977 B2 | 12/1973 |

(Continued)

OTHER PUBLICATIONS

U.S. Appl. No. 12/430,795, filed Apr. 27, 2009, Kwok.

(Continued)

*Primary Examiner* — Karl Kurple

(74) *Attorney, Agent, or Firm* — Fletcher Yoder, P.C.

(57) ABSTRACT

A system, in certain embodiments, includes a manifold including an air tube disposed about a water tube. The system also includes multiple nozzles coupled to the manifold, where each nozzle is coupled to the air tube and the water tube.

8 Claims, 21 Drawing Sheets

(56) References Cited

U.S. PATENT DOCUMENTS

| | | | | |
|---|---|---|---|---|
| 3,693,886 | A | 9/1972 | Conrad | |
| 3,701,269 | A | 10/1972 | Wilcox | |
| 3,825,379 | A | 7/1974 | Lohkamp et al. | |
| 4,067,703 | A | 1/1978 | Dullien | |
| 4,151,955 | A | 5/1979 | Stouffer | |
| 4,219,864 | A | 8/1980 | Grunenfelder et al. | |
| 4,280,851 | A | 7/1981 | Pitchon | |
| 4,686,069 | A | 8/1987 | Hahne et al. | |
| 4,802,625 | A | 2/1989 | Buschor | |
| 4,815,665 | A | 3/1989 | Haruch | |
| 4,830,279 | A | 5/1989 | Crum et al. | |
| 4,905,909 | A | 3/1990 | Woods | |
| 4,932,140 | A * | 6/1990 | Lepisto | 34/641 |
| 4,934,602 | A | 6/1990 | Mattson | |
| 4,946,101 | A * | 8/1990 | Winheim | 239/8 |
| 4,964,569 | A * | 10/1990 | Stevens | 239/13 |
| 5,133,502 | A | 7/1992 | Bendig et al. | |
| 5,180,104 | A | 1/1993 | Mellette | |
| 5,249,746 | A | 10/1993 | Kaneko | |
| 5,286,348 | A * | 2/1994 | Perin | 162/262 |
| 5,299,364 | A * | 4/1994 | Heikkila et al. | 34/460 |
| 5,435,491 | A | 7/1995 | Sakuma | |
| 5,456,414 | A | 10/1995 | Burns | |
| 5,478,014 | A * | 12/1995 | Hynds | 239/135 |
| 5,680,993 | A | 10/1997 | McCracken et al. | |
| 5,732,885 | A | 3/1998 | Huffman | |
| 5,862,986 | A | 1/1999 | Bolyard, Jr. | |
| 5,902,540 | A | 5/1999 | Kwok | |
| 5,904,298 | A | 5/1999 | Kwok et al. | |
| 5,927,609 | A | 7/1999 | Scarpa | |
| 5,992,763 | A | 11/1999 | Smith | |
| 6,032,565 | A | 3/2000 | Okonski | |
| 6,076,466 | A | 6/2000 | Siler et al. | |
| 6,098,897 | A * | 8/2000 | Lockwood | 239/8 |
| 6,200,635 | B1 * | 3/2001 | Kwok | 427/286 |
| 6,248,407 | B1 * | 6/2001 | Hess | 427/480 |
| 6,264,113 | B1 * | 7/2001 | Dingler | 239/8 |
| 6,267,301 | B1 | 7/2001 | Haruch | |
| 6,322,003 | B1 * | 11/2001 | Haruch | 239/290 |
| 6,334,579 | B1 | 1/2002 | Zarbi | |
| 6,383,293 | B1 | 5/2002 | Gao | |
| 6,602,554 | B1 | 8/2003 | Kwok | |
| 6,680,021 | B1 | 1/2004 | Kwok et al. | |
| 6,684,921 | B2 | 2/2004 | Tatsuno | |
| 6,694,870 | B1 * | 2/2004 | Pietikainen et al. | 100/38 |
| 6,739,697 | B2 | 5/2004 | Jackson | |
| 6,824,074 | B2 | 11/2004 | Komornicki | |
| 6,827,781 | B1 | 12/2004 | Hahne et al. | |
| 6,997,405 | B2 | 2/2006 | Haruch | |
| 7,021,571 | B1 | 4/2006 | Lawson et al. | |
| 7,114,910 | B2 | 10/2006 | Stalder | |
| 7,341,630 | B1 | 3/2008 | Pacetti | |
| 7,513,975 | B2 * | 4/2009 | Burma | 162/263 |
| 7,588,194 | B2 | 9/2009 | Shank | |
| 7,588,199 | B2 | 9/2009 | Huffman | |
| 7,648,335 | B2 | 1/2010 | Stalder | |
| 7,926,733 | B2 | 4/2011 | Micheli | |
| 2002/0048606 | A1 | 4/2002 | Zawistowski | |
| 2002/0069990 | A1 | 6/2002 | Augscheller et al. | |
| 2002/0088876 | A1 * | 7/2002 | Lewis et al. | 239/424 |
| 2002/0104597 | A1 | 8/2002 | Frank et al. | |
| 2003/0136861 | A1 | 7/2003 | Kangas et al. | |
| 2004/0112559 | A1 | 6/2004 | DuBourg | |
| 2004/0144872 | A1 * | 7/2004 | Scotchmur et al. | 239/600 |
| 2004/0188104 | A1 | 9/2004 | Borisov | |
| 2004/0261965 | A1 | 12/2004 | Burma | |
| 2005/0008474 | A1 | 1/2005 | Stalder | |
| 2005/0092775 | A1 | 5/2005 | Saidman et al. | |
| 2006/0000928 | A1 | 1/2006 | Micheli | |
| 2006/0019042 | A1 * | 1/2006 | Nojima et al. | 428/32.24 |
| 2006/0051516 | A1 * | 3/2006 | Pietikainen et al. | 427/426 |
| 2006/0086827 | A1 * | 4/2006 | Sekiya | 239/433 |
| 2006/0099335 | A1 | 5/2006 | Sakai | |
| 2007/0125886 | A1 * | 6/2007 | Zillig et al. | 239/556 |
| 2007/0125888 | A1 * | 6/2007 | Zillig et al. | 239/566 |
| 2007/0221540 | A1 * | 9/2007 | Dziadzio et al. | 208/113 |
| 2007/0266940 | A1 | 11/2007 | Choi | |
| 2008/0012159 | A1 | 1/2008 | Schmid | |
| 2008/0014364 | A1 * | 1/2008 | Brendel | 427/475 |
| 2008/0029234 | A1 | 2/2008 | Latti et al. | |
| 2008/0217262 | A1 | 9/2008 | Rijn | |
| 2008/0219262 | A1 | 9/2008 | Roay | |
| 2008/0295768 | A1 | 12/2008 | Micheli | |
| 2009/0224066 | A1 | 9/2009 | Riemer | |
| 2009/0250532 | A1 | 10/2009 | Calvo | |
| 2010/0224122 | A1 | 9/2010 | Vinnay | |
| 2010/0224665 | A1 | 9/2010 | Vinnay | |
| 2010/0224703 | A1 | 9/2010 | Kwok | |
| 2012/0095588 | A1 * | 4/2012 | Barkmann et al. | 700/117 |
| 2014/0353401 | A1 * | 12/2014 | Tynkkynen et al. | 239/112 |

FOREIGN PATENT DOCUMENTS

| | | |
|---|---|---|
| CH | 622444 | 4/1981 |
| DE | 2812881 | 10/1978 |
| DE | 3522882 | 1/1987 |
| DE | 8633956 | 4/1988 |
| DE | 3643380 | 6/1988 |
| DE | 3823739 | 1/1990 |
| DE | 19950009 | 4/2001 |
| EP | 0350606 | 1/1990 |
| EP | 1233834 | 8/2002 |
| GB | 392904 | 5/1933 |
| GB | 2073666 | 10/1981 |
| GB | 2074049 | 10/1981 |
| JP | 02220846 | 9/1990 |
| WO | WO0048742 | 8/2000 |
| WO | 0128693 | 4/2001 |
| WO | WO2006110510 | 10/2006 |
| WO | WO2010104620 | 9/2010 |
| WO | WO2010104621 | 9/2010 |
| WO | WO2010104625 | 9/2010 |
| WO | WO2010104627 | 9/2010 |
| WO | WO2010104633 | 9/2010 |

OTHER PUBLICATIONS

U.S. Appl. No. 12/430,802, filed Apr. 27, 2009, Vinnay et al.

U.S. Appl. No. 12/430,815, filed Apr. 27, 2009, Vinnay et al.

* cited by examiner

THERMALLY ISOLATED LIQUID SUPPLY FOR WEB MOISTENING

CROSS REFERENCE TO RELATED APPLICATIONS

This application is a continuation-in-part of U.S. patent application Ser. No. 12/400,146, entitled "Pneumatic Atomization Nozzle for Web Moistening", filed Mar. 9, 2009, which is herein incorporated by reference.

BACKGROUND

The invention relates generally to a pneumatic atomization nozzle for web moistening.

Magazines, books and other publications are frequently produced on heatset web offset printing presses. Offset printing involves transferring images to a web (e.g., roll of paper) via rotating drums. These drums have an inked impression of images which are transferred to the web as it travels across the rotating drums. In heatset printing, ink may be dried by blowing hot air over the web after the images have been imprinted. However, the hot air may reduce web moisture content, resulting in broken fibers, page growth and/or a wrinkled publication.

To prevent this detrimental wrinkling, some printing presses employ a web remoistening system. For example, a web remoistening system may be used to spray the web with water after the drying process to remoisten the web. Current web remoistening systems utilize hydraulic atomization to achieve the desired web moisture content. In hydraulic atomization, a liquid is forced through a small orifice at high pressure to create droplets. Systems that employ hydraulic atomization are expensive because they must be constructed to withstand high liquid pressure. In addition, they require expensive high pressure pumps, liquid manifolds and solenoid valves. Furthermore, because the orifice is small, it tends to get clogged by impurities in the water. Therefore, hydraulic atomization systems typically spray de-ionized water, increasing operational costs. Moreover, hydraulic atomization systems are not well suited for web moistening at low flow rates because they tend to produce smaller droplets, thereby causing poor remoistening efficiency.

BRIEF DESCRIPTION

A system, in certain embodiments, includes a manifold including an air tube disposed about a water tube. The system also includes multiple nozzles coupled to the manifold, where each nozzle is coupled to the air tube and the water tube.

DRAWINGS

These and other features, aspects, and advantages of the present invention will become better understood when the following detailed description is read with reference to the accompanying drawings in which like characters represent like parts throughout the drawings, wherein.

Figure 14:
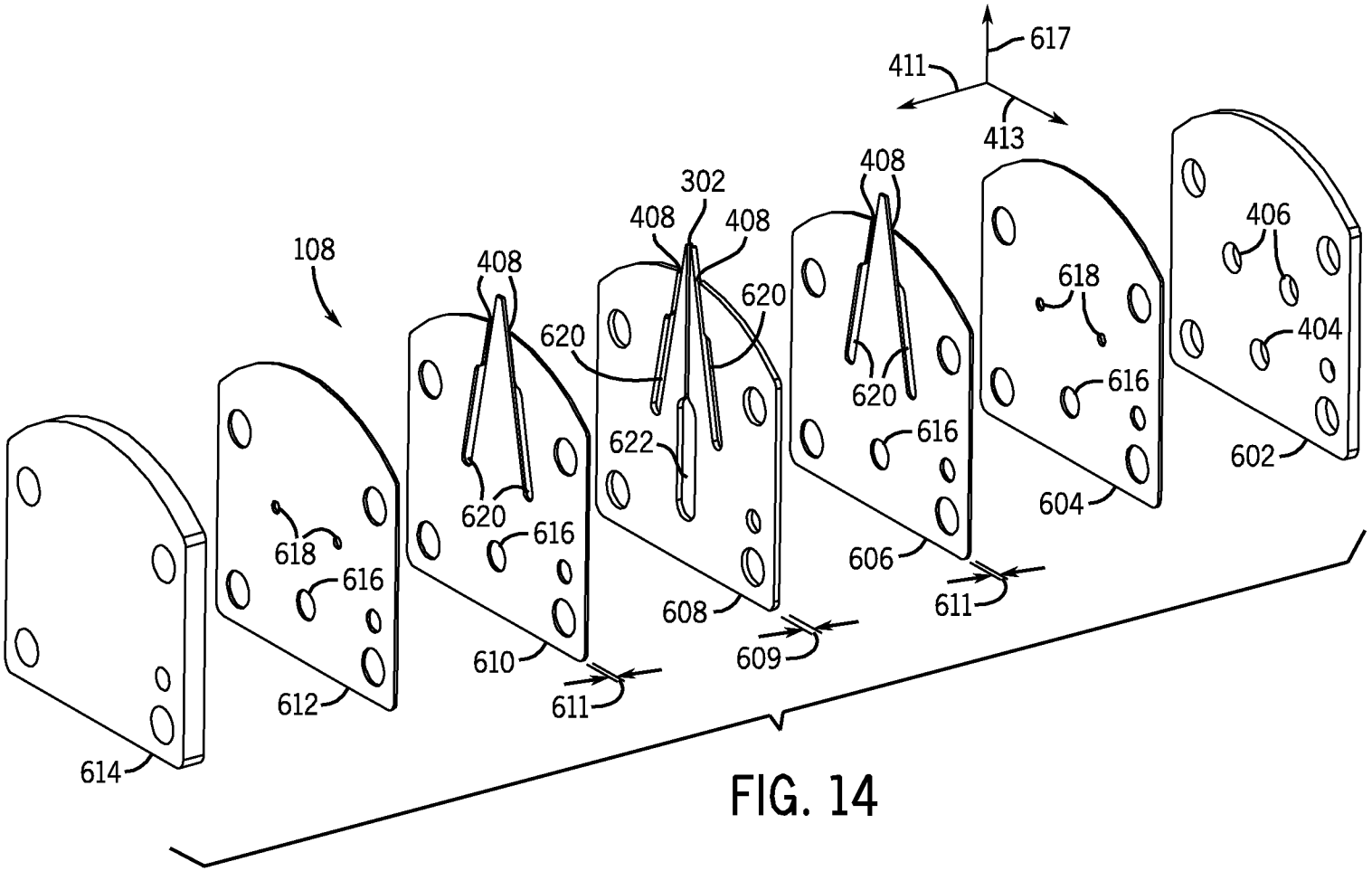
FIG. 14 is an exploded view of a spray device that may be employed in the web moistening system of FIG. 3 in accordance with certain embodiments of the present technique.
Figure 15:
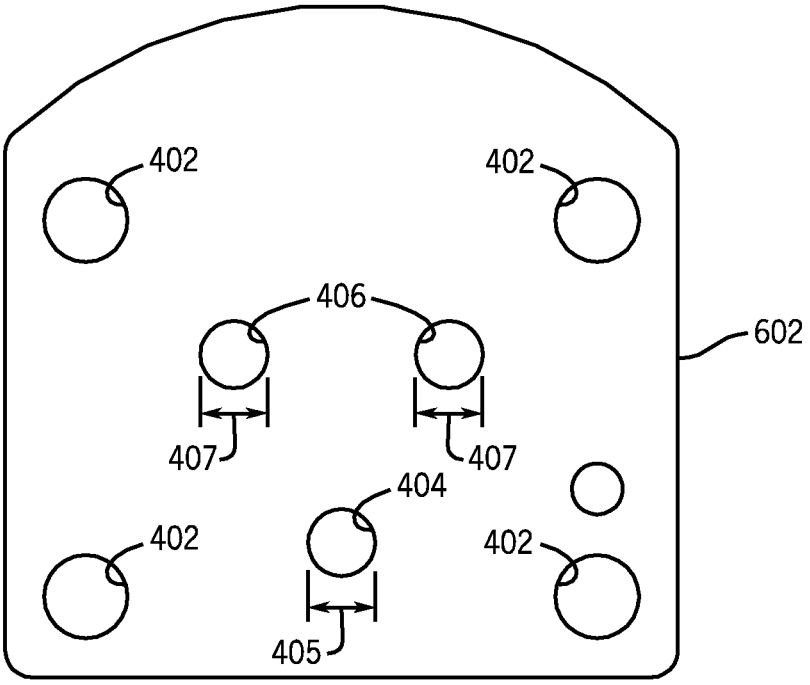
FIG. 15 is a top view of a first layer of the spray device represented in FIG. 14 in accordance with certain embodiments of the present technique.
Figure 24:
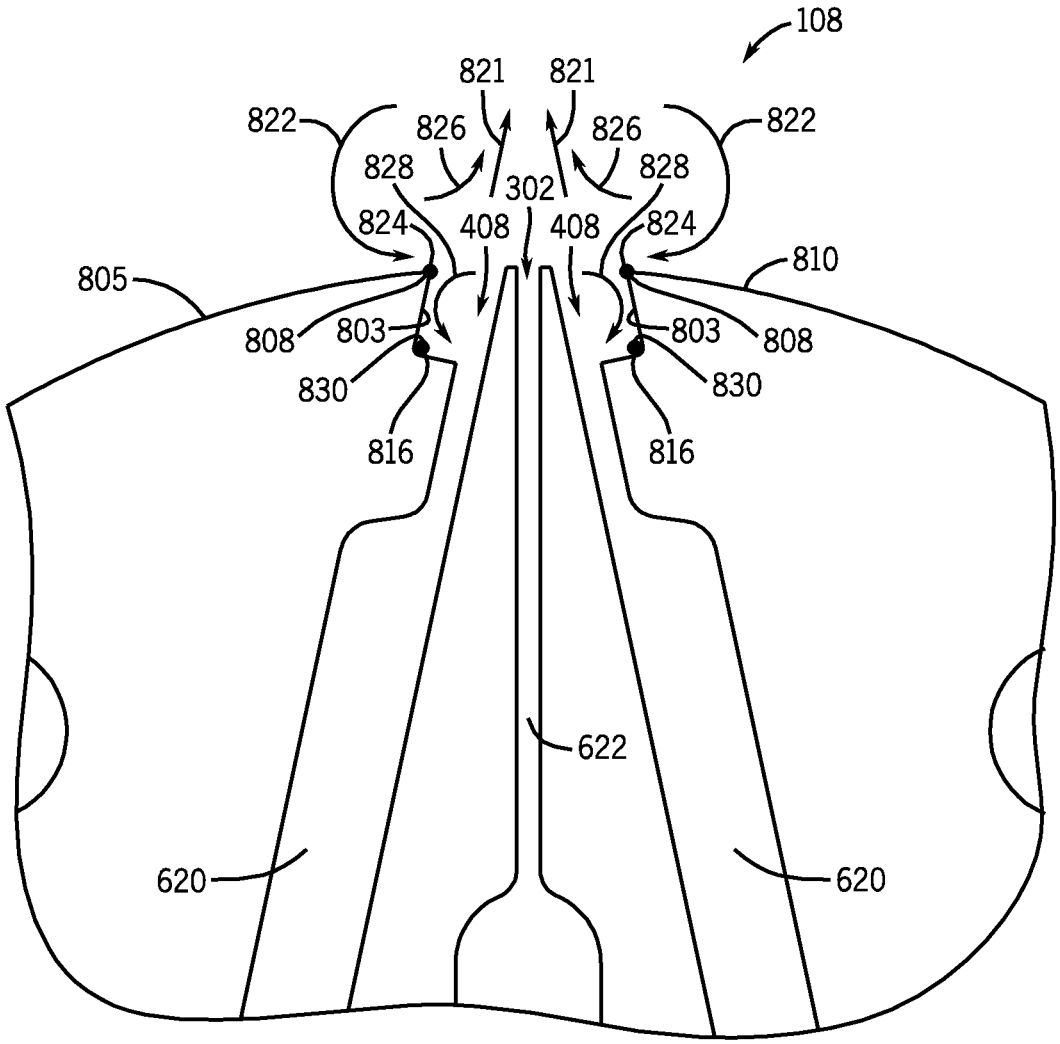
Figure 25:
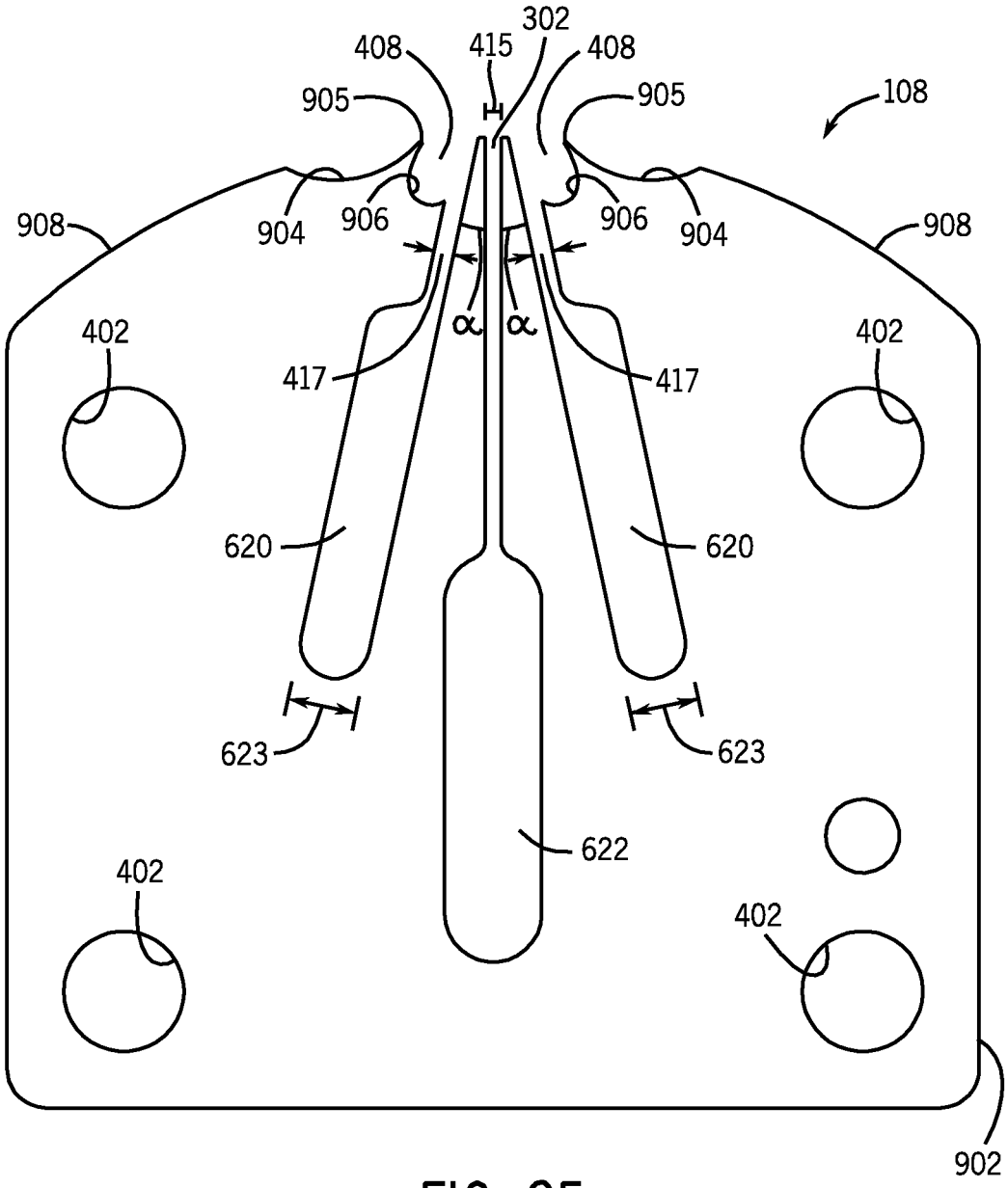

FIG. 24 is a detailed top view of the liquid and pneumatic orifices of the second alternative embodiment of the fourth layer of the spray device represented in FIG. 14 in accordance with certain embodiments of the present technique; and FIG. 25 is a top view of a third alternative embodiment of the fourth layer of the spray device represented in FIG. 14 in accordance with certain embodiments of the present technique.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

Embodiments of the present disclosure may reduce the cost of web moistening systems and provide enhanced moistening performance by employing pneumatic web moistening nozzles. For example, compared to hydraulic atomization, pneumatic systems may achieve effective web moistening with lower liquid pressures. Lower pressure operation may significantly reduce the production and/or operational costs associated with web moistening systems. For example, manifolds and nozzles may be constructed from less expensive materials such as aluminum, stainless steel or plastic. In addition, as compared to the machined components of hydraulic atomizers, the manifolds and nozzles may be constructed from laminated layers including internal passages that are secured together to form complete structures. Because these internal passages may be formed using less expensive techniques (e.g., laser cutting, water jet, plasma cutting, etching, etc.), the overall cost and production time of web moistening systems may be reduced. In addition, smaller and less expensive liquid pumps (e.g., gear pumps, peristaltic pumps, etc.) may be employed for pneumatic web moistening systems. In certain embodiments, these pumps may be configured to regulate the flow of liquid without utilizing expensive pressure regulating valves.

In further embodiments, the web moistening system may employ a modular design configured to reduce construction costs by enabling faster assembly of the system. Specifically, modules may include preassembled nozzles, valves, manifolds, and associated electronic devices. When a customer orders a web moistening system, an appropriate number of modules may be readily mounted to the system. This construction technique may significantly reduce assembly time compared to individually mounting each nozzle, manifold, valve and electronic component to the web moistening system. In addition, each module may include a protective hood configured to block water from entering the module and interfering with operation of the valves and/or electronic components. Furthermore, pressurized air may be routed to each module to increase the pressure under the hood such that the internal pressure is greater than the external air pressure. This arrangement may prevent humid outside air and/or debris from entering the module. In certain configurations, the hood may be constructed from a transparent or semi-transparent material, such as a translucent plastic, for example. Such a configuration may enable an operator to visually determine which nozzles are in operation via lights mounted within the module.

Further embodiments may include a manifold configured to provide air and liquid to the pneumatic nozzles. The manifold may include an air tube disposed about a water tube. This arrangement may limit the formation of condensation on the manifold. Specifically, the flow of air may thermally insulate the surface of the manifold from the cooler water. Maintaining the manifold at a warmer temperature may limit the formation of condensation. In certain configurations, the manifold may be positioned above a web. In such arrangements, limiting condensation on the manifold may prevent excess water from contacting and being absorbed by the web.

In certain embodiments, the pneumatic web moistening nozzle includes a liquid orifice and a pair of pneumatic orifices disposed on opposite sides of the liquid orifice. In this configuration, liquid droplets emitted from the liquid orifice may form a substantially flat fan-shaped pattern in a plane of the orifices. Furthermore, in certain embodiments, the pneumatic web moistening nozzle may be configured to reduce a buildup of salt and/or other minerals that may interfere with gas flow through the pneumatic orifices. Specifically, in one embodiment, a surface defining each pneumatic orifice may include an angled portion configured to provide a point adjacent to each pneumatic orifice. Due to the small surface area of the point, any collected minerals may be dislodged by gas flow through the pneumatic orifices and/or vibrations of the pneumatic web moistening nozzle, thereby reducing the accumulation of minerals that may obstruct gas flow. In a second embodiment, each pneumatic orifice may include an expansion portion disposed on a side opposite from the liquid orifice. It is believed that the expansion portions may induce recirculation, causing deposits to accumulate on an angled portion and/or within a corner of each expansion portion. Any collected minerals may be dislodged by gas flow through the pneumatic orifices and/or vibrations of the pneumatic web moistening nozzle, thereby reducing the accumulation of minerals that may obstruct gas flow.

As discussed in detail below, pneumatic web moistening nozzles may utilize larger liquid orifices and provide higher droplet velocities than hydraulic atomizers. The larger liquid orifice may be less prone to clogging because small particles may simply pass through instead of becoming lodged and obstructing liquid flow. Because the liquid orifice may be able to accommodate particles in the liquid, tap water may be used as the moistening liquid, instead of the more expensive de-ionized water. In addition, the larger liquid orifice may facilitate spraying other liquids, including silicone emulsions and lotion. Moreover, the higher droplet velocities may increase liquid deposition efficiency.

Figure 1:
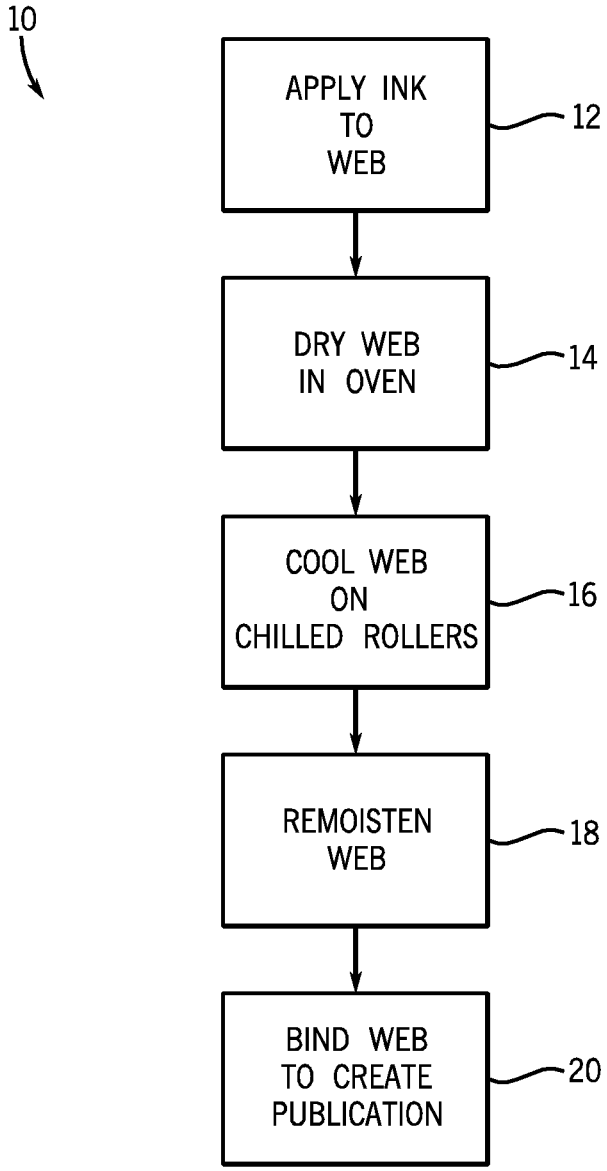
FIG. 1 is a process flow diagram of a printing process in accordance with certain embodiments of the present technique.

FIG. 1 presents a process flow diagram of heatset web offset printing 10 using a unique web remoistening system in accordance with certain embodiments of the invention. First, as represented by block 12, ink is applied to a web. The web may be paper, for example, or any other substrate to which ink may be applied. In alternative embodiments, the web 102 may be a metal sheet to which oil may be applied, for example. The web is stored in rolls, which are unwound as the web travels through the printing process 10. In offset printing, ink is first applied to a rotating plate cylinder by ink rollers. The ink is then transferred to an offset cylinder or rubber blanket cylinder which is in contact with the plate cylinder and rotating in the opposite direction. Finally, ink is applied to the web as it travels across the rotating offset cylinder.

However, the ink is still wet at this point in the printing process 10. Therefore, the process 10 may proceed to dry the ink in an oven, as represented by block 14. Web drying ovens generally circulate hot air over the web to dry the ink before it runs or smudges. Because the drying process 14 may leave the web excessively hot, the web may be cooled on a series of chilled rollers, as represented by block 16.

Heating the web in the oven, as represented by block 14, may have the undesirable effect of reducing web moisture content. If the web becomes too dry, wrinkling, broken fibers and/or page growth may occur during or after the binding process. Therefore, the printing process 10 may employ a liquid spray system to remoisten the web, as represented by block 18. For example, the web remoistening system may employ a series of nozzles which spray a liquid onto the web as it travels through the system. In the disclosed embodiments, the web remoistening system may include pneumatic web moistening nozzles that provide high droplet deposition efficiency and substantially uniform spray patterns, while reducing mineral buildup that may interfere with the spray patterns. This configuration may provide increased web speed through the web remoistening system. Once the proper moisture content has been established, the web may be bound into its final publication form, as represented by block 20. For example, the web may be folded, cut and bound into books, magazines or brochures.

Figure 2:
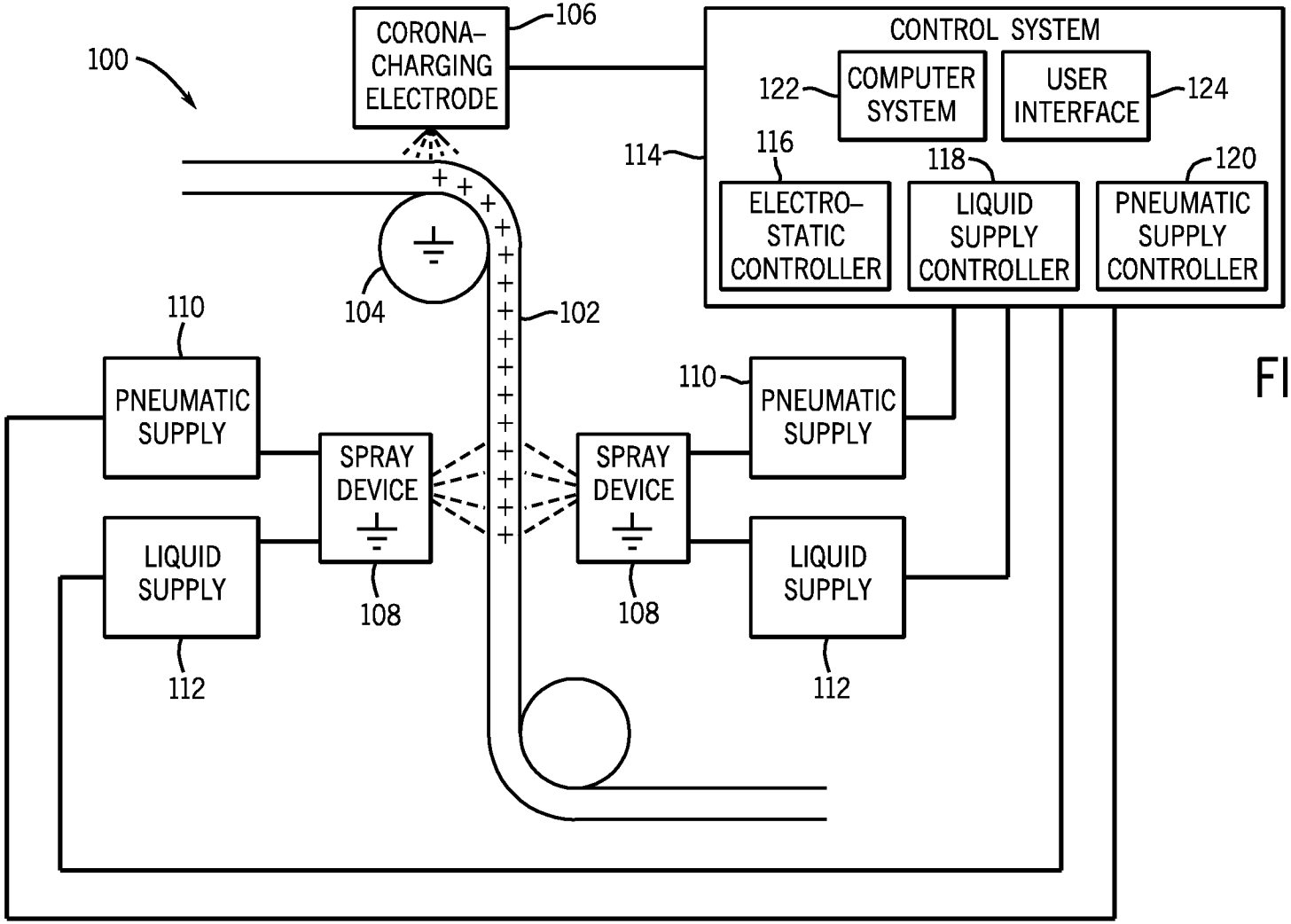
FIG. 2 is a block diagram of a web moistening system in accordance with certain embodiments of the present technique.

FIG. 2 shows a block diagram of one embodiment of a web moistening system 100 using a unique configuration to enhance droplet deposition efficiency, reduce mineral buildup and provide uniform droplet distribution in accordance with certain embodiments of the invention. As previously discussed, a web 102 may enter the moistening system 100 after it has been cooled by the chilled rollers. The web 102 may then pass over a grounded reversing roller 104 and be charged by a corona-charging electrode 106. The corona-charging electrode 106 bombards the web 102 with ions (charged particles), inducing a positive charge on the surface of the web 102. This positive charge is represented by plus signs located on the side of the web 102. To ensure that the maximum possible charge is applied, the reversing roller 104 may be grounded.

The web may then pass between a pair of spray devices 108. While only two spray devices 108 are depicted in FIG. 2, each spray device 108 may represent a series of spray devices 108 extending along the width of the web 102 (e.g., perpendicular to the page). Also, additional spray devices 108 may be positioned along the direction of travel of the web 102. The number and configuration of spray devices 108 may be selected to achieve proper web moisture content. Each spray device 108 may be grounded. During atomization, the positively charged web 102 may induce a negative charge on the liquid droplets. In alternative embodiments, the corona-charging electrode 106 may be configured to induce a negative charge on the surface of the web 102, which may impart a positive charge on the liquid droplets. As the droplets approach the web 102, they may then be electrostatically attracted to the web 102, resulting in enhanced atomization and/or increased liquid penetration.

The spray devices 108 in the present embodiment may be pneumatic atomizers. As discussed in detail below, pneumatic atomizers may utilize large liquid orifices and provide high droplet velocities. The large liquid orifice may be less prone to clogging because small particles may simply pass through instead of becoming lodged and obstructing liquid flow. For example, an area of the large liquid orifices may be approximately 0.03 to 10, 0.1 to 5, 0.15 to 1, or about 0.2 square millimeters. In contrast, an area of the smaller hydraulic orifices may be less than approximately 0.005 to 0.01 square millimeters. For example, in certain configurations, pneumatic orifices may be approximately 25 times larger than hydraulic orifices. Moreover, the high droplet velocities may increase liquid deposition efficiency. In addition, spray devices 108 employing pneumatic atomization may propel droplets a greater distance than hydraulic atomizers. Specifically, as air pressure to a pneumatic atomizer is increased, droplets may be propelled a greater distance. In contrast, increasing liquid pressure in a hydraulic atomizer decreases droplet size, thereby reducing the distance a droplet may travel. For example, hydraulic atomizers may propel droplets approximately 1 foot, while pneumatic atomizers may propel droplets approximately 1.5 to 3, 2 to 4, or about 2 feet. Spray devices 108 may use both a gas source and a liquid source. Gas may be supplied by pneumatic supplies 110, such as low pressure, high volume blowers, for example. Liquid may be supplied by liquid supplies 112. In this embodiment, a low liquid flow rate may be desired. Therefore, the liquid supplies 112 may include gear pumps or peristaltic pumps. For example, gear pumps may be configured to provide a constant flow of liquid to the spray devices 108. In addition, flow rate may be easily adjusted by varying gear speed, gear size and number of teeth on each gear.

In certain embodiments, the liquid supply 112 may include a storage tank configured to provide water, or other liquid, to the spray devices 108. In such configurations, the tank may be elevated relative to the spray devices 108 to deliver an appropriate water pressure for web moistening. For example, in certain embodiments, the hydraulic head alone (i.e., without a pump) may be used to deliver the liquid (e.g., water) to the spray devices 108. Alternatively, or in combination with an elevated tank, a pump (e.g., gear pump or peristaltic pump) may be coupled to the tank to deliver liquid to the spray devices 108 at a desire pressure and/or flow rate. In certain embodiments, the pump may be configured to pressurize the liquid to less than approximately 5, 4, 3, 2, or 1 bar, or approximately 0.1 to 1 bar, 0.2 to 0.9 bar, 0.3 to 0.8 bar, 0.4 to 0.7 bar, or about 0.5 bar. As appreciated, these liquid pressures are significantly lower than those used for hydraulic atomization. For example, hydraulic atomizers may operate at liquid pressures between approximately 5 to 100 bar. Lower pressure operation may significantly decrease the production and operational costs of the web moistening system 100 compared to higher pressure hydraulic atomization systems. For example, manifolds and nozzles for hydraulic atomizers are typically machined from solid blocks of material to eliminate joints that may leak at the higher pressures. Brass is generally employed for such pneumatic components because it is well suited for complex machining operations. However, machining components is both expensive and time consuming, thereby increasing production costs. In addition, to prevent corrosion of the brass components, caustic soda may be added to the liquid, thus increasing operational costs. In contrast, due to the lower pressures associated with pneumatic atomization, the manifolds and nozzles may be constructed from less expensive materials such as aluminum, composites (e.g., fiberglass), stainless steel or plastic, for example. In certain embodiments, the manifolds and/or nozzles may be constructed from extruded aluminum having an anti-corrosion coating. In addition, as compared to machining components, the manifolds and nozzles may be constructed from laminated layers including internal passages that are secured together to form complete structures. Because these internal passages may be formed using less expensive techniques (e.g., laser cutting, water jet, plasma cutting, etching, etc.), the overall cost and production time of the web moistening system 100 may be reduced.

As discussed above, certain embodiments may employ a gear pump to supply a liquid to the spray devices 108. A gear pump may include a housing containing a drive gear interlocked with an idle gear. The housing may be configured such that a minimum gap exists between an interior surface of the housing and teeth coupled to each gear. The drive gear may be coupled to a shaft that extends outside of the housing and is driven to rotate by an electric motor, for example. A liquid inlet and liquid outlet of the housing may be positioned perpendicular to the direction of gear rotation and aligned with the interlocking portion of the gears. As the drive gear rotates, the idle gear may be induced to rotate and liquid may be pumped from the inlet to the outlet via motion of the gear teeth. Specifically, as the teeth of the drive gear and idle gear rotate, liquid becomes trapped within a space defined by the gear teeth and the interior surface of the housing. As the gears rotate, the trapped liquid is transported from the inlet side of the housing to the outlet side. In this manner, the gear pump may provide a constant liquid flow.

Further embodiments may employ a peristaltic pump. A peristaltic pump may include an annular flexible conduit and a rotor configured to compress a portion of the conduit. The flexible conduit may be disposed adjacent to an interior surface of a substantially rigid annular structure, and the rotor may be disposed adjacent to the conduit on an opposite side from the annular structure. The rotor may be connected to a shaft disposed within the center of the annular structure and driven to rotate by an electric motor, for example. As the shaft rotates, the rotor compresses the flexible conduit against the rigid annular structure. The rotor then moves along the entire circumferential extent of the flexible conduit, thereby establishing a pressure differential between liquid at an entrance to the conduit and the liquid exiting the conduit. This pressure differential induces liquid to flow through the pump in discrete pulses. As appreciated, flow rates for both the gear pump and the peristaltic pump may be varied by adjusting the speed of the driving motor to achieve a desired liquid pressure within the web moistening system 100.

Alternative embodiments may utilize water provided by a public utility (i.e., tap water). However, the tap water may be supplied at greater than 3 bar, for example. Therefore, the liquid supply 112 may be configured to reduce the liquid pressure prior to the liquid entering the spray devices 108. For example, the liquid supply 112 may include a flow rate controller and/or a pressure regulator. The flow rate controller may be configured to selectively open and close a valve to allow a precise quantity of liquid to flow from the water source (e.g., public utility) to the spray devices 108, thereby establishing a desired liquid pressure. Similarly, the pressure regulator may be configured to reduce the incoming pressure to a desired level, while accounting for pressure variations in the supplied liquid. The flow rate controller and/or the pressure regulator may ensure that the spray devices 108 receive an appropriate liquid pressure (e.g., approximately 0.5 bar) such that a desired quantity of liquid is delivered to the web 102.

The corona-charging electrode 106, the pneumatic supplies 110 and the liquid supplies 112 may be controlled by a control system 114. The control system 114 may include an electrostatic controller 116, a liquid supply controller 118, a pneumatic supply controller 120, a computer system 122 and a user interface 124. For example, the electrostatic controller 116 may adjust the voltage and/or current supplied to the corona-charging electrode 106 based on a desired web charge. Similarly, the liquid supply controller 118 and the pneumatic supply controller 120 may adjust the output of the liquid supply 112 and the pneumatic supply 110. For example, if the liquid supplies 112 include gear pumps, the liquid supply controller 118 may adjust the speed of each gear pump based on a desired liquid flow rate. The liquid supply controller 118 may be described as a continuous flow controller, and may continuously adjust the gear pump to maintain accurate control of the flow rate. Each of the individual controllers may be regulated by the computer system 122 coupled to the user interface 124. The user interface 124 may allow an operator to adjust parameters of the web moistening system 100 through a graphical user interface.

Figure 3:
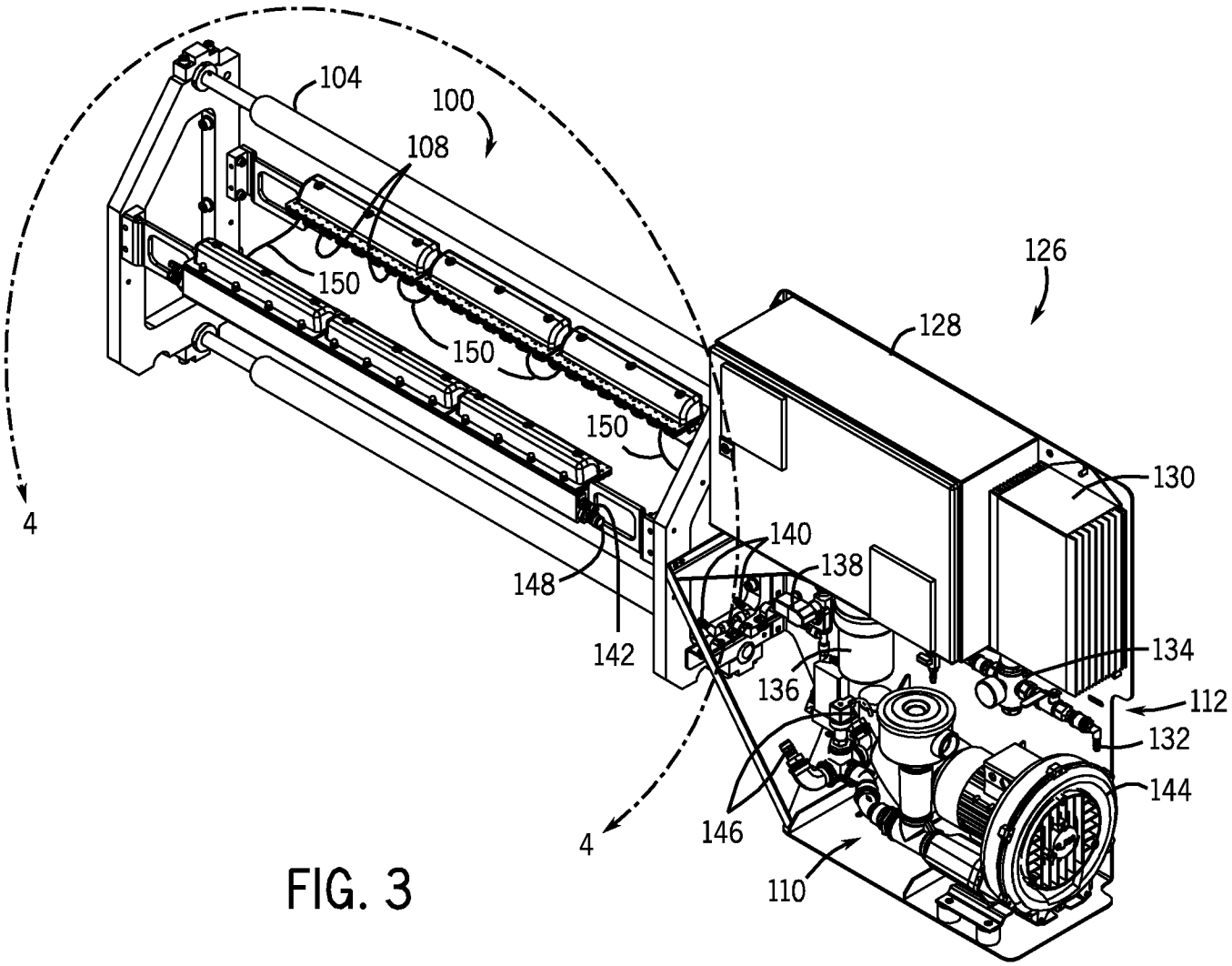
FIG. 3 is a perspective view of a web moistening system in accordance with certain embodiments of the present technique.

FIG. 3 is a perspective view of a web moistening system 100 having a unique atomization mechanism in accordance with certain embodiments of the invention. In this embodiment, the web (not shown) may enter along the reversing roller 104. The web may then pass between two rows of spray devices 108, one on each side of the web. Each spray device 108 may spray a fan shaped stream of liquid onto the web, establishing the desired moisture content. Because the present embodiment utilizes pneumatic atomizers, the liquid stream may have a greater velocity than web moistening systems 100 employing hydraulic atomizers. This higher velocity stream may increase liquid deposition efficiency.

As illustrated, a mechanical/electrical enclosure 126 is disposed adjacent to the web moistening section of the system 100. In certain embodiments, the enclosure 126 may be covered by one or more panels to protect the electrical and mechanical components disposed within the enclosure 126. The enclosure 126 includes a control cabinet 128 that may include elements of the control system 114 previously described with regard to FIG. 2. Furthermore, the enclosure 126 includes a high-voltage electrical supply 130 that may provide electrical power to the corona-charging electrode 106. Components of the pneumatic supply 110 and the liquid supply 112 are also contained within the enclosure 126.

In the present embodiment, the liquid supply 112 includes a liquid inlet 132, an inlet pressure controller 134, a liquid filter 136, a flow rate controller 138, and liquid outlets 140. For example, water from a public utility may enter the liquid supply 112 through the liquid inlet 132. The water may then flow into the inlet pressure controller 134 (e.g., pressure regulator). The inlet pressure controller 134 may be configured to reduce the pressure of the incoming water to a desired level appropriate for web moistening. The inlet pressure controller 134 may also monitor incoming water pressure to ensure the pressure is sufficient for web moistening. The water may then flow into the liquid filter 136 to remove contaminants that may be present within the tap water. Specifically, the liquid filter 136 may be configured to collect particulate matter within the water such that the particulates do not obstruct flow paths downstream from the filter 136. The water flows from the filter 136 to the flow rate controller 138. As previously described, the flow rate controller 138 may be configured to provide continuous liquid flow regulation, i.e., accurate control and/or precise adjustment of liquid flow rates. In certain embodiments, the flow rate controller 138 may include a flow meter coupled to a low pressure controller configured to monitor and continuously adjust liquid flow to achieve a desired level. For example, pressure may be adjusted such that the spray devices 108 provide approximately 2 grams of water for each square meter of the web 102, thereby establishing a proper web moisture content. As appreciated, the flow rate may be higher or lower depending upon the configuration of the web 102 (e.g., initial moisture content, material properties, binding operations, etc.). For example, the flow rate controller 138 may be configured to enable the spray devices 108 to provide approximately 0.5, 1, 1.5, 2.5, 3, 3.5, 4, 5, 6, 8, 10, or more grams of water for each square meter of the web 102. The water from the flow rate controller 138 then flows to the liquid outlets 140. A hose (not shown) or other suitable fluid connector may couple the flow rate controller 138 to the liquid outlets 140.

Alternative embodiments may include a gear pump or peristaltic pump to flow the liquid from the liquid inlet 132 to the liquid outlets 140. For example, if the liquid pressure entering the liquid inlet 132 is lower than a desired pressure for web moistening, the pump may increase the pressure to the desired level. In addition, the pump may be configured to precisely regulate the pressure and/or flow rate of liquid provided to the spray devices 108. In certain embodiments, the pump may have sufficient control of liquid flow to obviate the pressure regulating functions of the inlet pressure controller 134 and/or the flow rate controller 138. In such embodiments, these controllers 134 and/or 138 may be omitted. However, as appreciated, a peristaltic pump may provide uneven flow due to the pulsating nature of the pumping system. Therefore, configurations employing a peristaltic pump may also include the flow rate controller 138 downstream from the pump to provide a substantially constant liquid pressure to the outlets 140. The liquid outlets 140, in turn, may provide liquid to a liquid inlet 142 within the web moistening section of the system 100. A hose or other fluid connector (not shown) may couple the outlets 140 to an inlet 142 on each row of spray devices 108.

The pneumatic supply 110 may include a blower 144 and pneumatic outlets 146. As previously discussed, the blower 144 may be configured to provide low-pressure, high-volume air to the spray devices 108. For example, the blower 144 may provide air at a flow rate of about 1 to 20, 2 to 10, or approximately 2 to 5 standard cubic feet per hour. This configuration may enable the spray devices 108 to properly atomize the liquid provided by liquid supply 112. In certain embodiments, the spray devices 108 may be configured to utilize a constant pneumatic flow rate. In such embodiments, the blower 144 may be a constant speed blower, thereby reducing the cost of the web moistening system 100. In further embodiments, the constant speed blower may be coupled to a valve configured to vent a portion of the air to the outside. By adjusting the position of this valve, variable pneumatic flow rates may be achieved with a constant speed blower. Air may be transferred from the pneumatic outlets 146 to a pneumatic inlet 148 disposed on each row of spray devices 108. A hose or other pneumatic connector (not shown) may couple the outlets 146 to the inlets 148.

In addition, the web moistening system 100 includes a series of cables 150 that link the control cabinet 128 with spray devices 108. In certain embodiments, the cables 150 are configured to provide both electrical power and control signals to the spray devices 108. Alternatively, separate control and power cables 150 may be employed. As discussed in detail below, the spray devices 108 may be organized into modules, with each module including a circuit board. A valve associated with each spray device 108 may be coupled to the circuit board within each module. A cable 150 electrically couples the control cabinet 128 to a first module. Another cable 150 then couples the first module to a second module. Further cables 150 are provided such that each module is linked to a successive module. Control signals from the control cabinet 128 flow through the cables 150 to each successive module. For example, the web moistening system 100 may employ the controller-area network (CAN or CAN-bus) standard to facilitate communication between the control cabinet 128 and each module. This standard may enable various components of the web moistening system 100 to communicate with one another without a host computer. Further embodiments may utilize the CANopen standard, which is an open protocol and may be better suited for web moistening systems 100. In certain embodiments, a single cable 150 may connect with multiple modules, e.g., a single cable may include multiple connectors to plug into the multiple modules. For example, the system may include a single cable 150 for each row of modules or a single cable 150 for all modules. Using the one or more cables 150, the control system 114 may control the operation of each spray device 108. For example, certain webs 102 may not extend along the entire width of the web moistening assembly. In such situations, certain spray devices 108 (i.e., those not adjacent to the web 102) may be deactivated by closing valves associated with those spray devices 108. This configuration may conserve water by only activating spray devices 108 adjacent to the web 102. In certain embodiments, web width and position may be determined automatically via sensors in the web moistening system 100. The control system 114 may then activate the appropriate spray devices 108 based on the detected web width and position.

Figure 4:
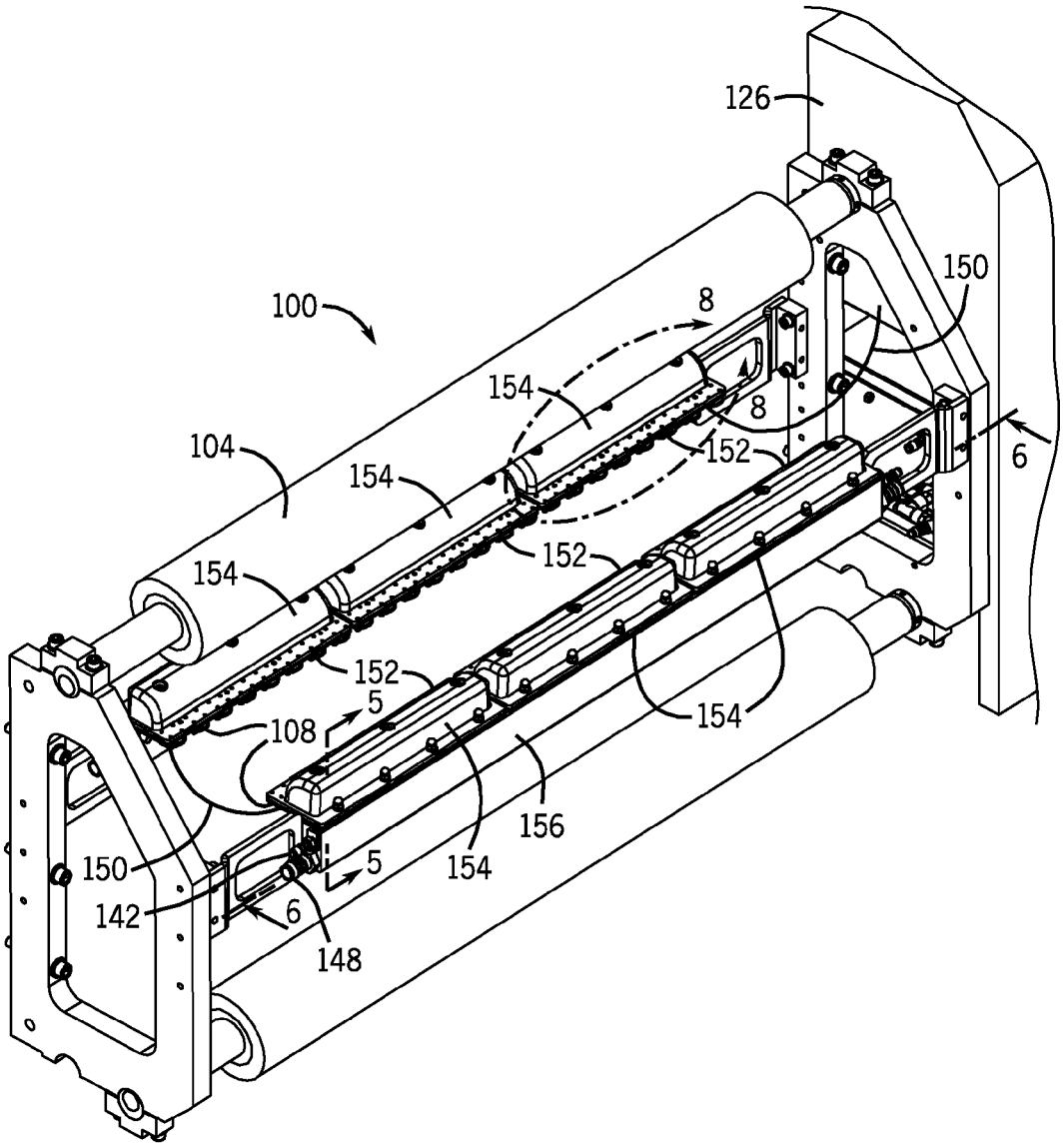
FIG. 4 is a perspective view of a modular web moistening assembly taken within line 4-4 of FIG. 3 in accordance with certain embodiments of the present technique.

FIG. 4 is a perspective view of a modular web moistening assembly taken within line 4-4 of FIG. 3. As illustrated, three modules 152 are positioned on each row of spray devices 108. More or fewer modules 152 may be employed in alternative embodiments. For example, certain configurations may include 1, 2, 4, 5, 6, 7, 8, 9, 10, or more modules 152 positioned along each side of the web 102. The number of modules 152 may be selected based on web width. For example, web moistening systems 100 configured to accommodate narrower webs 102 may include fewer modules than those configured to accommodate wider webs 102. In addition, while 8 spray devices 108 are coupled to each module 152, more or fewer spray devices 108 may be included in alternative embodiments. For example, certain embodiments of the modules 152 may include 2, 3, 4, 5, 6, 7, 9, 10, 12, 14, 16, or more spray devices 108 per module 152.

This modular configuration may reduce construction costs by enabling faster assembly of the web moistening system 100. For example, a number of modules 152 may be assembled and stored. Each module 152 may include preassembled spray devices 108, valves, manifolds, and associated electronic devices. When a customer orders a web moistening system 100 configured to accommodate a particular web width, an appropriate number of modules 152 may be readily removed from storage and mounted to the system 100. This construction technique may significantly reduce assembly time compared to individually mounting each spray device 108, manifold, valve and electronic component to the web moistening system 100. Reduced construction time may facilitate lower manufacturing costs and faster deliver times.

In addition, each module 152 includes a protective hood 154 disposed on an opposite side from the spray devices 108. In alternative embodiments, the hood 154 may be disposed on the same side of each module 152 as the spray devices 108. The hood 154 may serve to block water from the spray devices 108 from entering the module 152 and interfering with operation of the valves and/or electronic components. This configuration may further reduce construction costs compared to individually sealing each valve/electronic assembly associated with each spray device 108. Pressurized air from the pneumatic supply 110 may be routed through a conduit within a manifold 156 to each module 152. The pressurized air may increase the pressure under the hood 154 such that the internal pressure is greater than the external air pressure. This arrangement may block or oppose entry of external debris or humid outside air into the module 152 without employing expensive hood sealing devices. For example, the moisture content of the outside air may be greater than approximately 80% relative humidity due to the presence of water droplets from the spray devices 108. This moist air may interfere with operation of the valves and/or electronic components within the module 152. Therefore, blocking outside air from entering the module 152 via internal pressurization may ensure proper operation of the components within module 152.

In certain configurations, the hood 154 may be constructed from a transparent or semi-transparent material, such as a translucent plastic, for example. Such a configuration may enable an operator to visually determine which spray devices 108 are in operation via lights mounted within the module. As previously discussed, each spray device 108 may have an associated valve configured to regulate the flow of liquid and/or air into the spray device 108. These valves may be coupled to a common circuit board disposed within each module 152. The circuit board may include a series of lights corresponding to the position of each valve. For example, the circuit board may include one light emitting diode (LED) for each valve. The LED may be configured to illuminate when the valve is open (i.e., the associated spray device 108 is in operation). In certain embodiments, a green light may indicate operation, a red light may indicate no operation, and/or a yellow light may indicate a problem. Any configuration of lights and colors may be used to indicate operational characteristics of the valves and other components of the modules 152. In this configuration, an operator may determine the position of each valve by visually inspecting the LEDs through the transparent or semi-transparent hood 154. This hood configuration may reduce construction costs compared to configurations employing opaque hoods 154 with lights mounted on the surface. Specifically, the transparent or semi-transparent hood 154 may obviate additional components and operations associated with sealing passages for wires and/or connectors coupled to external lights.

As illustrated, the cable 150 connects the mechanical/electrical enclosure 126 to a first module 152. In certain embodiments, the cable 150 is configured to electrically couple to the circuit board within the first module 152 via a first connector mounted on the bottom of the module 152. A second connector on the bottom of the first module 152 may couple the circuit board to a second cable 150 that electrically couples the first module 152 to a second module 152. Similar configurations may be employed to link each of the modules 152 together. This configuration may reduce construction costs compared to systems employing one or more cables linking each spray device 108 to the enclosure 126. Furthermore, because the cable 150 does not pass through the hoods 154, the hoods 154 may be manufactured without holes and/or sealing devices (e.g., grommets), thereby reducing the cost of hood construction.

Figure 5:
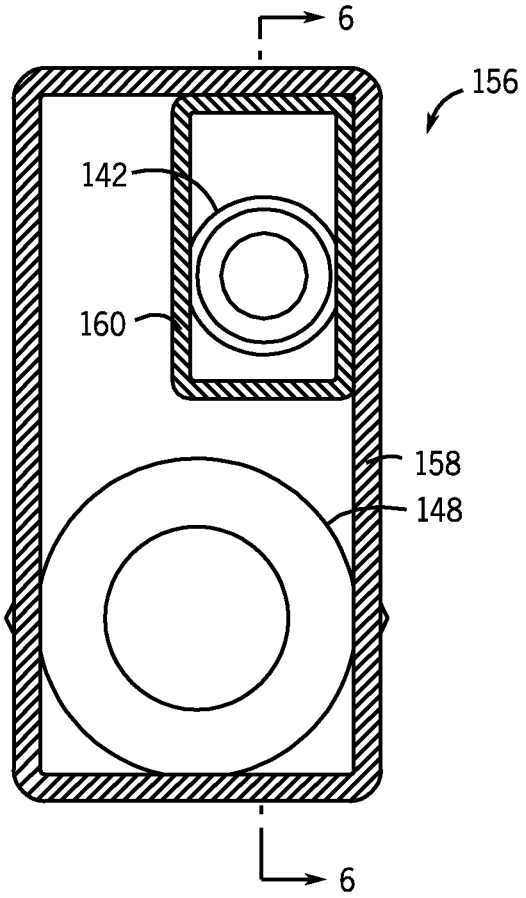
FIG. 5 is a cross-sectional side view of a manifold having a thermally isolated liquid passage taken along line 5-5 of FIG. 4 in accordance with certain embodiments of the present technique.

FIG. 5 is a cross-sectional side view of the manifold 156 including a thermally isolated liquid passage taken along line 5-5 of FIG. 4. The manifold 156 includes an outer structure defining a pneumatic passage 158 configured to provide air from the pneumatic supply 110 to the spray devices 108. The manifold 156 also includes an inner structure defining a liquid passage 160 configured to provide liquid from the liquid supply 112 to the spray devices 108. As illustrated, the liquid passage 160 is nested within the pneumatic passage 158. In other words, the pneumatic passage 158 circumscribes the liquid passage 160. In the present embodiment, both the liquid passage 160 and the pneumatic passage 158 are rectangular. Alternative embodiments may employ other cross-sectional configurations, such as circular, polygonal or elliptical, for example. In addition, the liquid passage 160 of the present embodiment contacts the pneumatic passage 158 along two surfaces. In further embodiments, the liquid passage 160 may contact 0, 1 or 3 surfaces. As illustrated, the air inlet 148 is coupled to the pneumatic passage 158, while the liquid inlet 142 is coupled to the liquid passage 160. This coaxial configuration may reduce the formation of condensation on the surface of the manifold 156.

As previously discussed, evaporation of liquid droplets may increase air moisture content to approximately 80% or higher relative humidity. Therefore, if the liquid passing through a liquid passage is colder than the surrounding air, condensation may form on the liquid passage. As seen in FIG. 4, one row of spray devices 108 is positioned directly above one of the rollers. Therefore, any condensation that forms on a liquid passage may potentially fall onto the web 102. In addition, because the web may be positively charged, a negative charge may be induced on the falling droplets. In certain configurations, the charge may be sufficient to attract droplets toward the web 102 even if a row of spray devices 108 is not positioned directly above a roller. The opposite charge may cause the droplets to be readily absorbed into the web 102, thus resulting in excessive and non-uniform web moisture content. Furthermore, the water droplets may stain the web, thereby rendering a portion of the web unacceptable for publication. Therefore, limiting the formation of condensation on the surface of the manifold 156 may reduce the possibility of excessive and non-uniform web moisture and/or staining of the web.

As appreciated, increasing air pressure also increases air temperature. Therefore, pressurized air from the blower 144 may be warmer than the outside air. As illustrated in FIG. 5, this warm air flowing through the air passage 158 may at least partially surround the liquid passage 160, thereby thermally insulating the liquid from the outside air. Specifically, the warm air within the air passage 158 may increase the surface temperature of the manifold 156 such that significantly less condensation forms on the manifold 156. In other words, the warm air may thermally isolate the liquid passage 160 from the surface of the manifold 156, thereby reducing condensation. In certain embodiments, the system may include a heater to elevate the temperature of the air, the manifold 156, or a combination thereof.

Figure 6:
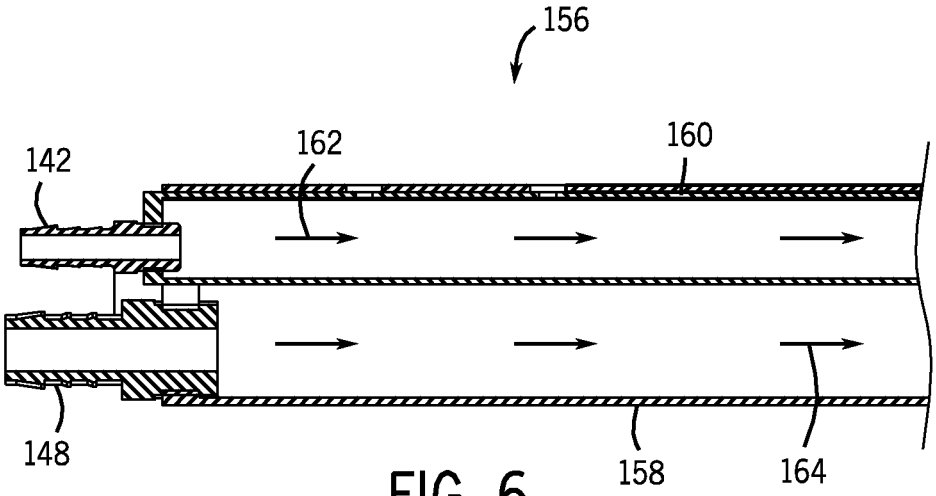
FIG. 6 is a partial cross-sectional front view of the manifold having a thermally isolated liquid passage taken along line 6-6 of FIG. 5 in accordance with certain embodiments of the present technique.

FIG. 6 is a partial cross-sectional front view of the manifold 156 taken along line 6-6 of FIG. 5. The liquid flowing in direction 162 may cause condensation to form on the liquid passage 160. However, because the liquid passage 160 is completely circumscribed by the pneumatic passage 158, any condensation that forms on the surface of the liquid passage 160 may be contained within the pneumatic passage 158. Furthermore, condensation may be dislodged and captured by air flow in direction 164, and ultimately expelled through the spray devices 108.

Figure 7:
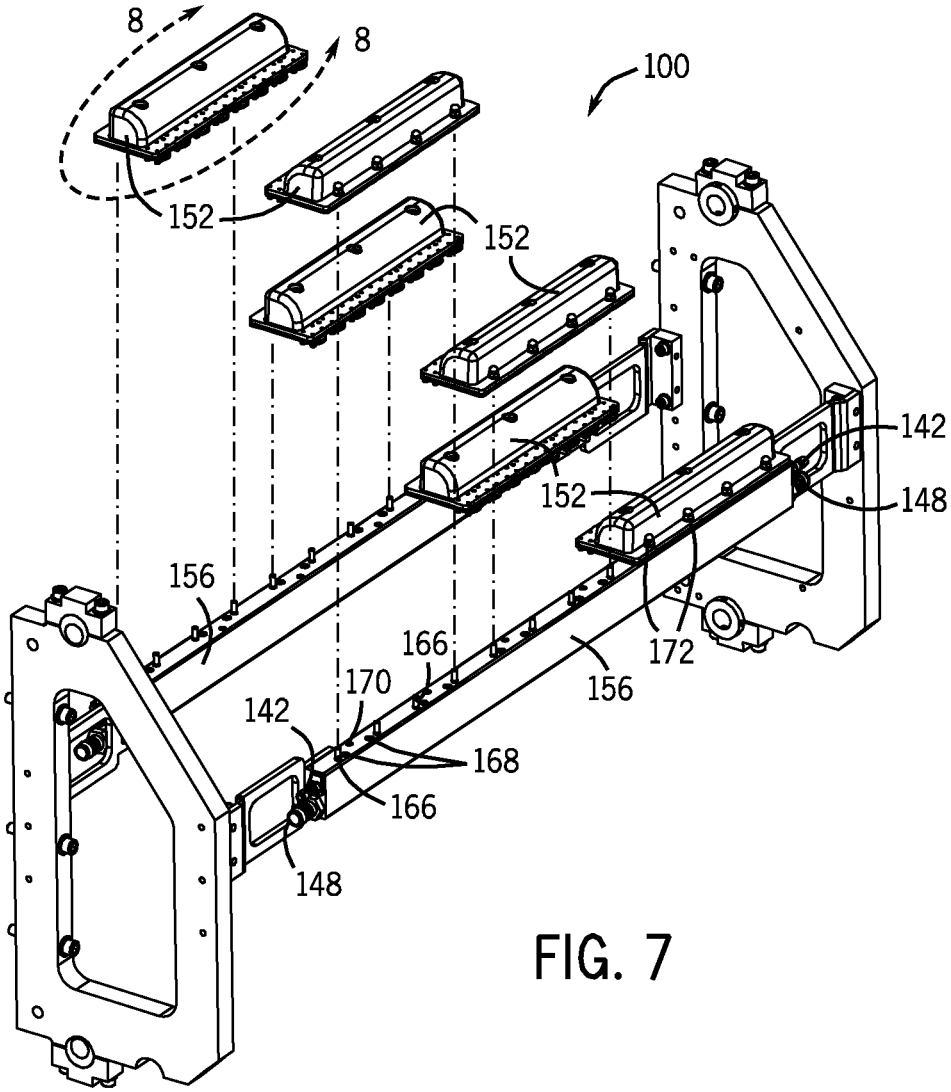
FIG. 7 is an exploded perspective view of the modular web moistening assembly of FIG. 4 showing certain web moistening modules separated from the manifold in accordance with certain embodiments of the present technique.

FIG. 7 is an exploded perspective view of the modular web moistening assembly of FIG. 4 showing certain web moistening modules 152 separated from the manifold 156. As previously discussed, this configuration may reduce construction costs by facilitating decreased assembly time of the web moistening system 100. As illustrated, the manifolds 156 may serve to support the modules 152 in addition to providing liquid and air to the spray devices 108. Specifically, each module 152 may be secured to the manifold 156 by bolts 166. While four bolts per module are illustrated in FIG. 7, alternative embodiments may include more or few bolts, such as 2, 3, 5, 6, 7, 8, or more bolts 166. In addition, manifold 156 includes four liquid passages 168 and two pneumatic passages 170 for each module 152. As appreciated, more or fewer passages 168 and/or 170 may be employed in alternative embodiments. For example, the manifold 156 may include 1, 2, 3, 4, 5, 6, 7, 8, 9, 10, or more passages 168 and/or 170 for each module 152. As discussed in detail below, each module 152 includes corresponding orifices configured to align with the passages 168 and 170 within the manifold 156. In this configuration, both liquid and air may flow into the modules 152 and ultimately to the spray devices 108. The modules 152 also include fasteners 172 configured to secure to bolts 166, thereby coupling the modules 152 to the manifold 156. In the illustrated embodiment, the modules 152 are arranged in two parallel rows with three modules 152 per row. In other embodiments, each row may include 1, 2, 3, 4, 5, 6, 7, 8, 9, 10, or more modules 152 per row depending on the size and nature of the web moistening system 100.

Figure 8:
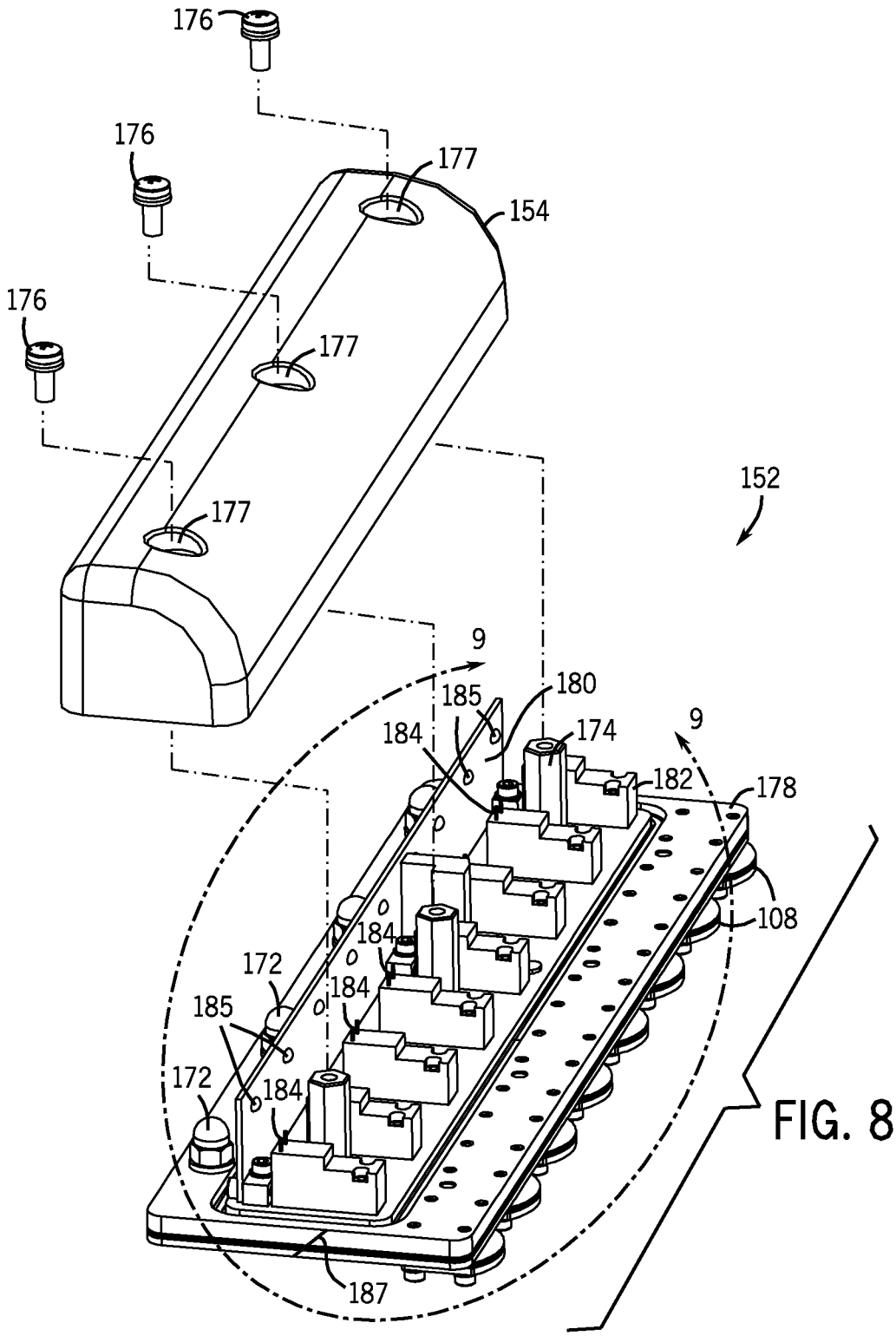
FIG. 8 is an exploded top perspective view of a module of the modular web moistening assembly taken within line 8-8 of FIG. 7 in accordance with certain embodiments of the present technique.

FIG. 8 is an exploded top perspective view of a module 152 of the modular web moistening assembly taken within line 8-8 of FIG. 7. As illustrated, the hood 154 has been separated from the remainder of the module structure. The module 152 includes stand-off posts 174 configured to secure the hood 154 to the module 152 via bolts 176. Specifically, three bolts 176 may pass through openings 177 in the hood 154 and secure to the stand-off posts 174, thereby coupling the hood 154 to a manifold 178. More or fewer bolts 176, openings 177 and stand-off posts 174 may be employed in alternative embodiments. For example, the module 152 may include 1, 2, 4, 5, 6, 7, 8, or more bolts 176, openings 177 and stand-off posts 174.

As previously discussed, the hood 154 may serve to protect a circuit board 180 and valves 182 from external moisture and other contaminants. As illustrated, the circuit board 180 is mounted perpendicular to the manifold 178. In alternative configurations, the circuit board 180 may be mounted parallel and adjacent to the manifold 178 (i.e., between the manifold 178 and the valves 182), or above the valves 182. In the present embodiment, each valve 182 is positioned directly opposite the manifold 178 from each spray device 108. As discussed in detail below, the manifold 178 is configured to direct a flow of liquid through each valve 182 prior to directing the liquid into the spray device 108. Each valve 182 includes a connector 184 that may be coupled to the circuit board 180. As previously discussed, the cable 150 may couple to the circuit board 180 to control the operation of the valves 182. Control signals from the cable 150 may pass through the circuit board 180 to each of the valves 182 via the connectors 184. Such an arrangement may reduce construction costs compared to providing each valve 182 with an individual electronic control unit. In certain embodiments, the connectors 184 may be configured to plug directly into the circuit board 180. This configuration may reduce construction costs due to decreased assembly time and fewer parts (e.g., connecting wires). In addition, LEDs 185 may be mounted to the circuit board 180 to indicate the operation of each spray device 108. For example, a control signal may direct a valve 182 to open. The circuit board 180 may include circuitry configured to detect the position of each valve 182 and illuminate an LED associated with the valve 182 to indicate valve position (e.g., lit LED indicates valve is open).

In further embodiments, the circuit board 180 may include additional circuitry configured to directly control valve operation based on input pressures or flow rates. For example, the control system 114 may output a desired liquid flow rate to each of the modules 152 via the cables 150. Circuitry within each circuit board 180 may then adjust the liquid flow through each spray device 108 to achieve the desired flow rate. This configuration may facilitate an even distribution of liquid droplets across the web 102.

In certain embodiments, the manifold 178 may be composed of multiple layers. These layers may be stacked to form a complete structure including internal liquid and pneumatic passages. As illustrated, the manifold 178 includes an orientation guide 187 to ensure proper orientation (e.g., stacking) of the multiple layers. In certain embodiments, the guide 187 may be a diagonal mark 187 on one side or edge of the multiple layers. Specifically, if any layer is not in the correct order, the mark 187 may not appear as a diagonal line. This configuration may serve to ensure proper flow of air and liquid through the manifold 178. The mark 187 may be located at any suitable position about the circumference of the manifold 178. The mark 187 may be etched into the structure of the manifold 178 or marked on the surface. In alternative embodiments, the orientation guide 187 may include an arcuate line, a series of indents, a series of notches, or the like, wherein these indicia indicate a proper order of the layers. As discussed in detail below, a similar orientation guide may be used on multiple layers of the spray devices 108.

Figure 9:
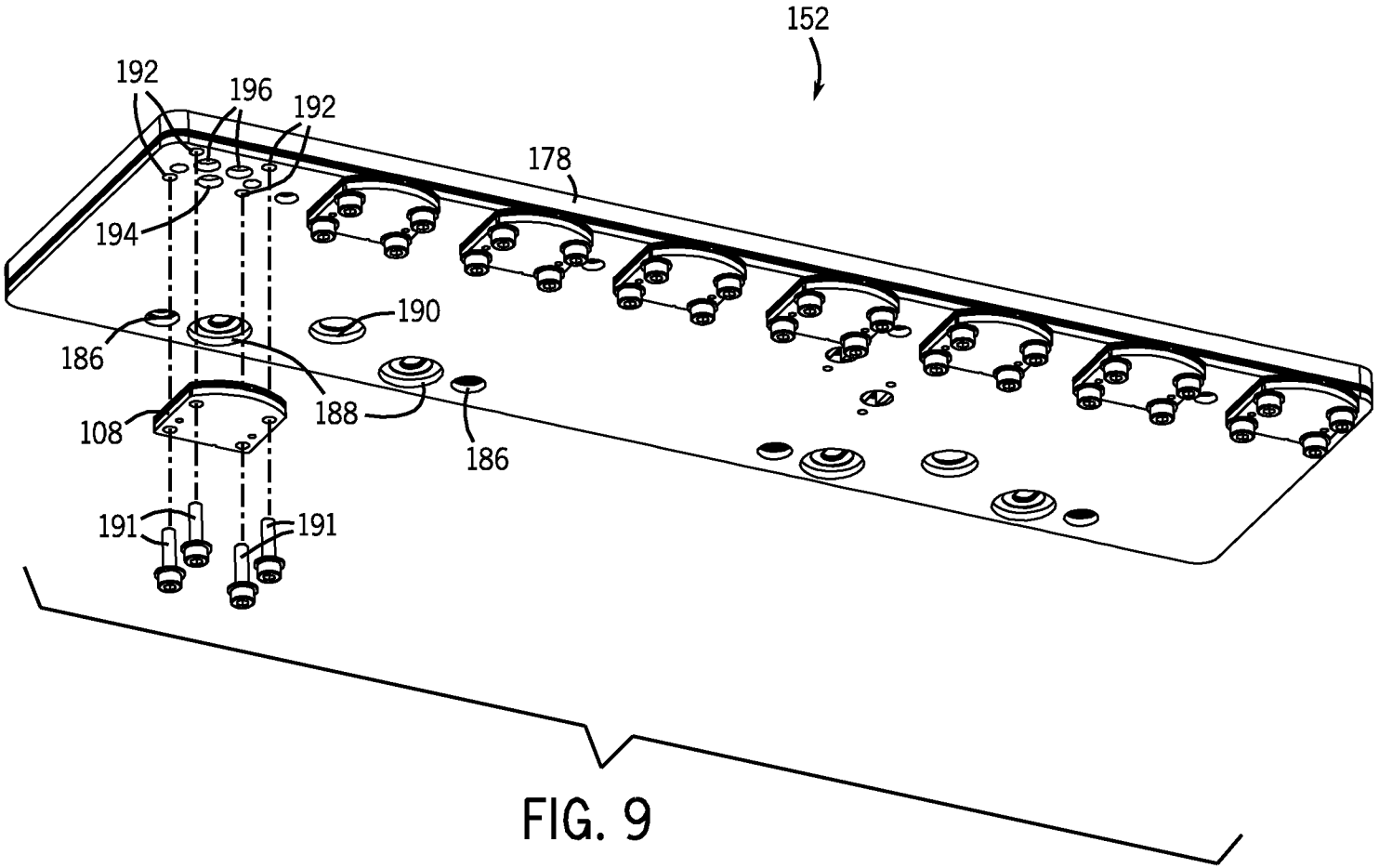
FIG. 9 is an exploded bottom perspective view of a manifold and spray device assembly taken within line 9-9 of FIG. 8 in accordance with certain embodiments of the present technique.

FIG. 9 is an exploded bottom perspective view of a manifold 178 and associated spray devices 108 taken within line 9-9 of FIG. 8, showing a spray device 108 removed from the manifold 178. As illustrated, the manifold 178 includes 4 openings 186 configured to facilitate passage of bolts 166 through the manifold 178 such that the bolts 166 may couple with fasteners 172 to secure the manifold 178 to the manifold 156. In addition, manifold 178 includes four liquid inlets 188 and two air inlets 190. These inlets 188 and 190 are configured to provide liquid and air, respectively, to each of the spray devices 108.

The spray devices 108 are each secured to the manifold 178 by four bolts 191 configured to pass through the spray device 108 and secure to the manifold 178 via four corresponding bolt holes 192. The manifold 178 also includes a liquid outlet 194 and two pneumatic outlets 196 for each spray device 108. As discussed in detail below, each spray device 108 includes corresponding pneumatic and liquid inlets. This configuration may facilitate the passage of air and liquid from the pneumatic and liquid inlets 188 and 190, through the pneumatic and liquid outlets 194 and 196, to the spray devices 108.

As discussed in detail below, the spray devices 108 may include multiple layers secured together by the bolts 191. However, these layers may be pre-assembled prior to delivery to a customer. For example, if a spray device 108 is not functioning properly, it may be removed for maintenance. However, once the bolts 191 are removed the layers may separate from one another, thereby increasing the possibility that the layers may be reassembled in an incorrect order. Therefore, each spray device 108 may include one or more bolts or rivets that secure the layers together. This configuration may facilitate enhanced removal and attachment of spray devices 108. In certain embodiments, the securing bolt or rivet may be located in a corner of the spray device 108 such that each layer may rotate with respect to the next. In such a configuration, passages within the spray device 108 may be cleaned without creating a possibility that the layers may be reordered.

Furthermore, as illustrated, the spray devices 108 are secured below the manifold 178 (i.e., along the direction of travel of the web 102). This configuration reduces the possibility that dirt and/or other contaminants may clog passages within the spray devices 108 during operation and/or while removing and reinstalling spray devices 108. For example, due to high web speeds, contaminants attached to the web 102 may be dislodged and impact the modules 152. However, because the spray devices 108 are positioned below the manifold 178, any debris from the web 102 may be deposited on an opposite surface from the spray devices 108. This configuration may increase the time between maintenance cycles, thereby reducing the operational costs associated with the web moistening system 100.

Figure 10:
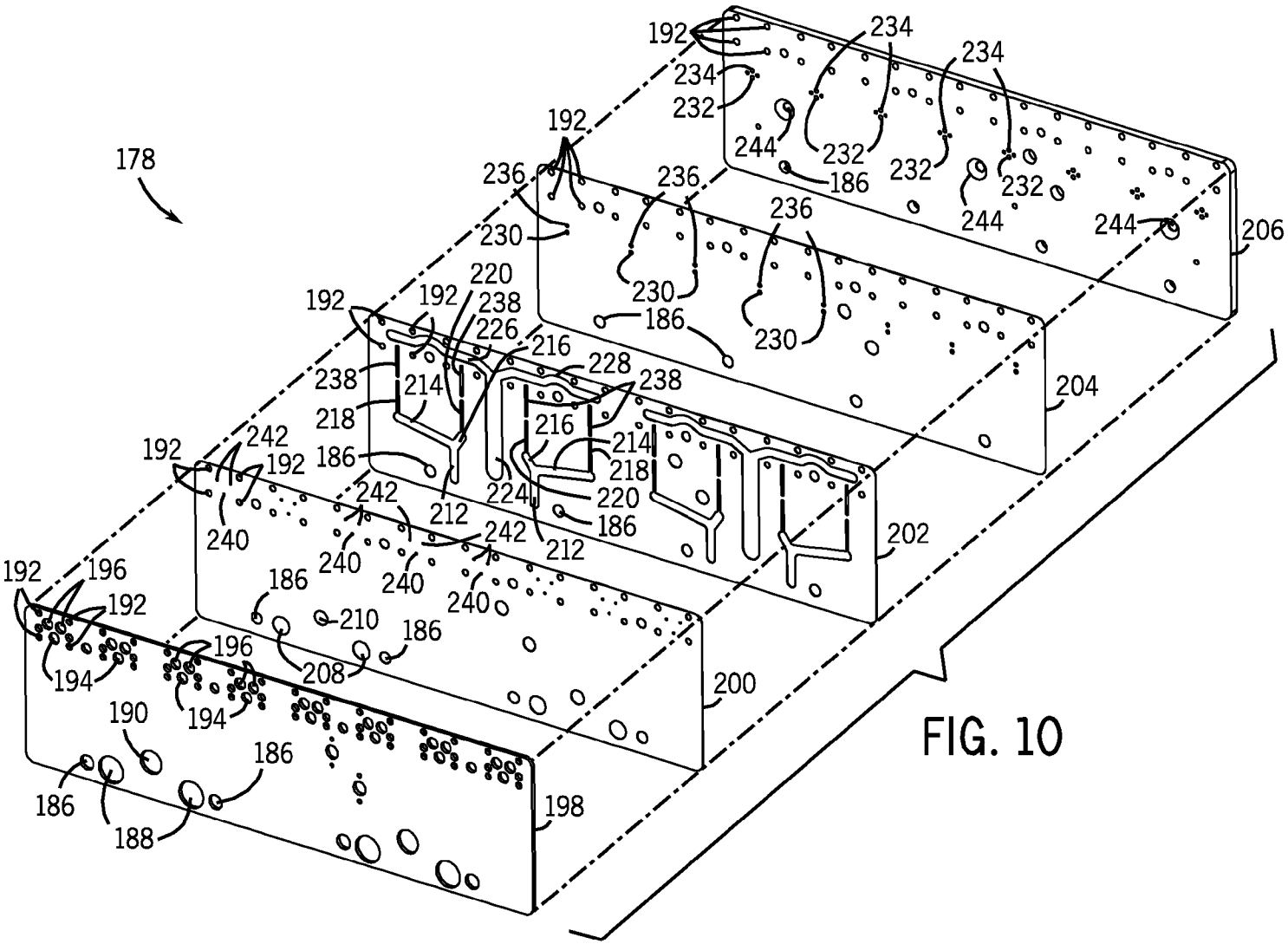
FIG. 10 is an exploded perspective view of multiple layers of a manifold that may be used in the module of FIG. 8 in accordance with certain embodiments of the present technique.

FIG. 10 is an exploded view of a manifold 178, showing individual layers that comprise flow paths within the manifold 178. Specifically, manifold 178 includes a first layer 198, a second layer 200, a third layer 202, a fourth layer 204 and a fifth layer 206. The first layer 198 corresponds to the portion of the manifold 178 coupled to the spray devices 108, while the fifth layer 206 corresponds to the portion coupled to the valves 182. As previously discussed, the first layer 198 includes bolt holes 186 configured to couple the manifold 178 to the manifold 156. The first layer 198 also includes liquid inlets 188 and pneumatic inlets 190, configured to receive air and liquid from the manifold 156. Furthermore, the first layer 198 includes liquid outlets 194 and pneumatic outlets 196 configured to provide the spray devices 108 with liquid and air, respectively.

As illustrated, the bolt holes 186 extend through each layer 198, 200, 202, 204 and 206. This configuration enables the bolts 166 to pass through the entire manifold 178 and engage the fasteners 172. Liquid entering liquid orifices 188 may pass through liquid passages 208 in the second layer 200. Similarly, air from the pneumatic orifices 190 may pass through pneumatic passages 210. As illustrated, the diameter of the liquid passages 208 is smaller than the diameter of the liquid inlets 188, and the diameter of the pneumatic passages 210 is smaller than the diameter of the pneumatic inlets 190. The difference in diameters may facilitate insertion of O-rings within the liquid passages 208 and/or the pneumatic passages 210, thereby providing a seal between the manifold 178 and the manifold 156. In alternative embodiments, diameters of the passages 208 and/or 210 may be substantially the same or larger than the diameters of the respective inlets 188 and/or 190.

The air and liquid may then pass into passages within the third layer 202. Specifically, the third layer 202 includes liquid passages 212, 214, 216, 218 and 220, and pneumatic passages 224, 226 and 228 that extend within the plane of the layer 202. Liquid from the liquid passage 208 may enter a first planar liquid passage 212. As illustrated, the width of the first planar liquid passage 212 is smaller than the diameter of the liquid passage 208. As appreciated, alternative embodiments may employ a liquid passage 212 having a width substantially similar to or greater than the diameter of liquid passage 208. A second planar liquid passage 214 and a third planar liquid passage 216 branch off from the first planar liquid passage 212. In this configuration, substantially equal quantities of liquid may be directed to each passage 214 and 216. Furthermore, liquid passing through liquid passage 214 flows into a smaller width planar liquid passage 218, while liquid passing through liquid passage 216 flows into a smaller width planar liquid passage 220. The width of passages 218 and 220 may be configured to facilitate proper liquid flow into each spray device 108. In other words, the passages 218 and 220 may ensure a substantially equal pressure drop between each spray device, each module 152 and generally across the web moistening system 100.

In a similar arrangement, air from the air passage 210 flows into the planar air passage 224 in the third layer 202. The air flow is then split between two planar air passages 226 and 228 that extend in a substantially perpendicular direction to the air passage 224. As illustrated, the width of the branched passages 226 and 228 is smaller than the width of the air passage 224. This configuration may establish a substantially even air flow to each of the spray devices 108.

Returning to the liquid flow path, liquid from planar liquid passages 218 and 220 may flow through liquid passages 230 in the fourth layer 204 and exit the manifold 178 through liquid outlets 232 in the fifth layer 206. As illustrated, the diameters of the liquid passages 230 and the liquid outlets 232 are substantially similar to the widths of the planar liquid passages 218 and 220. Alternative embodiments may include liquid passages 230 and/or liquid outlets 232 having smaller or larger diameters than the widths of the liquid passages 218 and 220. As best seen in FIG. 8, valves 182 are disposed on the manifold 178 adjacent to the fifth layer 206. Specifically, one valve is positioned directly adjacent to each liquid outlet 232. In this configuration, liquid exiting the manifold 178 through liquid outlet 232 may enter the valve 182. If the valve 182 is in a closed positioned, the path of the liquid terminates at the valve. However, if the valve 182 is in an open position, liquid may pass through the valve 182 and reenter the manifold 178 through a liquid inlet 234, also disposed adjacent to the valve 182. The liquid may then flow through a liquid passage 236 in the fourth layer 204 and enter a planar liquid passage 238 in the third layer 202. Finally, the liquid may pass through a liquid passage 240 in the second layer 200 before exiting the manifold 178 through the liquid outlet 194. As illustrated, the diameter of the liquid passage 240 may be substantially smaller than the width of the planar liquid passage 238. This configuration may serve to maintain a substantially even pressure drop across the manifold, while supplying a proper quantity of liquid to the spray devices 108.

In contrast to the liquid flow path, air from the two planar air passages 226 and 228 may be directed back to the second layer 200. Specifically, because the fourth layer 204 does not include pneumatic passages, air flow may be restricted to layers 198, 200 and 202. Therefore, air from the passages 226 and 228 may flow through air passages 242 within the second layer 200 and exit the manifold 178 through the pneumatic orifices 196. Similar to the liquid configuration, the diameter of the passages 242 may be configured to maintain a substantially even pressure drop across the manifold, while supplying a proper quantity of air to the spray devices 108. As appreciated, the thickness of each layer may be configured to establish a suitable flow of air and liquid through the manifold 178. Furthermore, each illustrated layer may be representative of multiple layers. For example, in certain embodiments, layer 202 may include 2, 3, 4, 5, 6, 7, or more layers to establish an appropriate thickness.

The arrangement of air and liquid passages described above may be configured to provide a substantially equal air and liquid pressure to each spray device 108, thus establishing an even flow of water droplets across the web 102. As previously discussed, the layers 198, 200, 202, 204 and 206 may be composed of aluminum or stainless steel, and secured together by bolts 166. Alternative configurations may employ plastic layers that may be laser welded together to form the manifold 178. For example, the layers may be composed of a plastic that is semi-transparent to infrared radiation. After the layers are aligned, an infrared laser may project a beam into the layers, inducing the layers to fuse together. Such a configuration may provide reduced construction costs compared to aluminum or stainless steel layers, while providing enhanced sealing between layers. This enhanced sealing may enable higher pressure operation compared to bolted layers. Alternatively, aluminum, composite or stainless steel layers may be sealed using various welding, soldering, brazing, diffusion bonding, or adhesion techniques (e.g., via adhesives). Thus, the layered construction of the manifolds 178 may include one or more material bonds along seams between the layers. The material bonds may be along edges, faces, or both, of the adjacent layers. As appreciated, in addition to the multi-layered assembly described above, other embodiments of the manifold 178 may be constructed using alternative techniques. For example, the manifold 178 may be machined from solid blocks of material.

Figure 11:
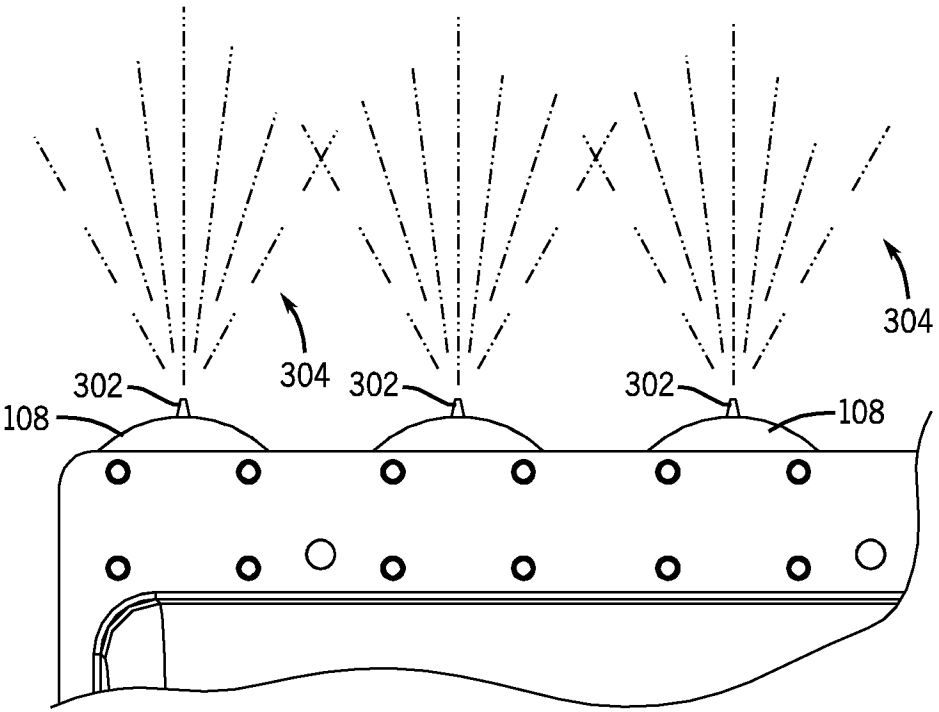
FIG. 11 is a top view of three spray devices that may be employed in the web moistening system of FIG. 3 in accordance with certain embodiments of the present technique.

FIG. 11 is a top view of three spray devices 108 that may be employed in the present embodiment. As illustrated, each spray device 108 may project a fan-shaped droplet pattern 304 from a liquid orifice 302. The fan-shaped droplet pattern 304 may be substantially flat and oriented in a direction perpendicular to the direction of travel of the web. The liquid streams 304 depicted in FIG. 11 overlap each other as they expand, thereby providing substantially uniform water distribution across the web. In other embodiments, the spacing of the spray devices 108 and/or the angle of each fan-shaped droplet pattern 304 may be varied to alter the amount of overlap. Adjustment of these parameters may be based on a desired level of web moistening.

Figure 12:
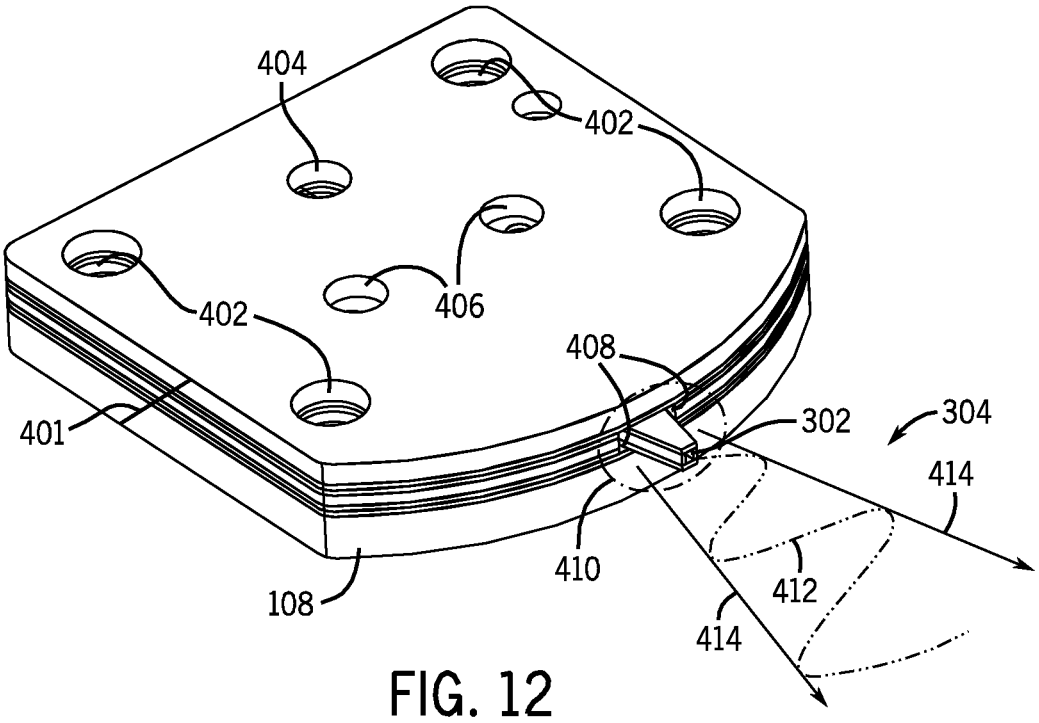
FIG. 12 is a perspective view of a spray device that may be employed in the web moistening system of FIG. 3 in accordance with certain embodiments of the present technique.

FIG. 12 is a perspective view of a spray device 108 having a unique atomization mechanism in accordance with certain embodiments of the invention. As discussed in detail below, the spray device 108 may be composed of layers, with each layer bolted together to form a complete apparatus. In the present embodiment, spray device 108 includes an orientation guide 401 to ensure proper orientation (e.g., stacking) of the multiple layers. In certain embodiments, the guide 401 may be a diagonal mark 401 on one side. Specifically, if any layer is not in the correct order, the mark 401 may not appear as a diagonal line. This configuration may serve to ensure proper flow of air and liquid through the spray device 108. The mark 401 may be located at any suitable position about the circumference of the spray device 108. The mark 401 may be etched into the structure of the spray device 108 or marked on the surface. In alternative embodiments, the orientation guide 401 may include an arcuate line, a series of indents, a series of notches, or the like, wherein these indicia indicate a proper order of the layers. After the layers have been properly aligned (i.e., a diagonal line is visible), bolts may pass through holes 402 to secure the layers. These bolt holes 402 may pass through the entire spray device 108.

A liquid inlet 404 may serve to deliver liquid from the liquid supply 112 to the liquid orifice 302. Similarly, pneumatic inlets 406 may facilitate gas flow from the pneumatic supply 110 through the spray device 108 to pneumatic orifices 408. Both the liquid orifice 302 and the pneumatic orifices 408 are components of the nozzle 410.

Liquid exiting the liquid orifice 302 may be separated into droplets by pneumatic atomization. The liquid orifice 302 may emit liquid at a relatively low flow rate, while the pneumatic orifices 408 may expel gas at a relatively high flow rate. Interaction between the high flow rate gas and the low flow rate liquid may cause the liquid to break up into droplets. Furthermore, some of the energy from the gas may be transferred to the liquid, increasing liquid droplet velocity. Because droplet velocity is a function of gas flow rate, pneumatic atomization may produce high velocity droplets while maintaining a low liquid flow rate. In other words, pneumatic atomizers may vary droplet velocity independently of the liquid flow rate. This configuration, unattainable with hydraulic atomization, may be well-suited for web moistening where greater droplet velocity and lower liquid flow rates are desired.

As seen in FIG. 12, the liquid droplets emitted from liquid orifice 302 form a substantially flat fan-shaped pattern 304. This pattern 304 may include vacillating droplets established by gas streams emanating between the pneumatic orifices 408. Specifically, two gas streams emanating from the pneumatic orifices 408 may converge near the liquid orifice 302. These high velocity gas stream may induce a liquid stream emitted from liquid orifice 302 to form vacillating droplets. FIG. 12 shows an exemplary droplet 412 as it vacillates in space between boundaries 414. This droplet 412 is merely representative of droplets formed through the pneumatic atomization process. The frequency and amplitude of this vacillation may be controlled by varying the liquid and/or gas flow rates, the liquid and/or gas velocities, and/or the spacing between the liquid orifice 302 and the pneumatic orifices 408. Adjusting the parameters of droplet vacillation is described in more detail in U.S. Pat. No. 5,902,540, which is herein incorporated by reference in its entirety.

Droplet vacillation may not be visible in the fan-shaped streams 304 depicted in FIG. 11 because each droplet may vacillate at a high frequency. A combination of this high frequency vacillation and a large number of droplets may create the appearance of the relatively flat fan-shaped droplet pattern 304. The particular fan-shaped pattern 304 created by this vacillation may result in uniform web moistening.

The flow rates of both liquid and gas are particularly adjusted to maintain the fan-shaped droplet pattern 304. Specifically, if the gas flow rate is too high relative to the liquid flow rate, liquid droplets may not properly vacillate to form the fan spray pattern 304. Without proper vacillation, the flattened fan-shaped pattern 304 may rotate approximately 90°, resulting in ineffective web moistening due to uneven liquid distribution across the web. For example, in certain embodiments, the liquid flow rate may be about 2 to 100, 5 to 70, 10 to 50, or approximately 10 to 30 cubic centimeters per minute. For example, if the liquid flow rate is approximately 10 to 30 cubic centimeters per minute, a gas flow rate of about 1 to 20, 2 to 10, or approximately 2 to 5 standard cubic feet per hour may produce proper droplet vacillation.

The liquid orifice 302 depicted in FIG. 12 protrudes from the front face of the spray device 108 such that the liquid orifice 302 is positioned downstream from the gas flow of pneumatic orifices 408. As illustrated, the protrusion is both rectangular and tapered. Alternative embodiments may employ a liquid orifice 302 having a non-tapered protrusion and/or a non-rectangular configuration. For example, in certain embodiments, the protrusion may have a circular, elliptical or triangular cross-section. This protrusion may facilitate automatic unclogging of the liquid orifice 302. A portion of the gas emitted from each pneumatic orifice 408 may pass over the liquid orifice 302. In this configuration, if an object or liquid on the surface obstructs the flow of liquid, the gas flow may dislodge it.

Figure 13:
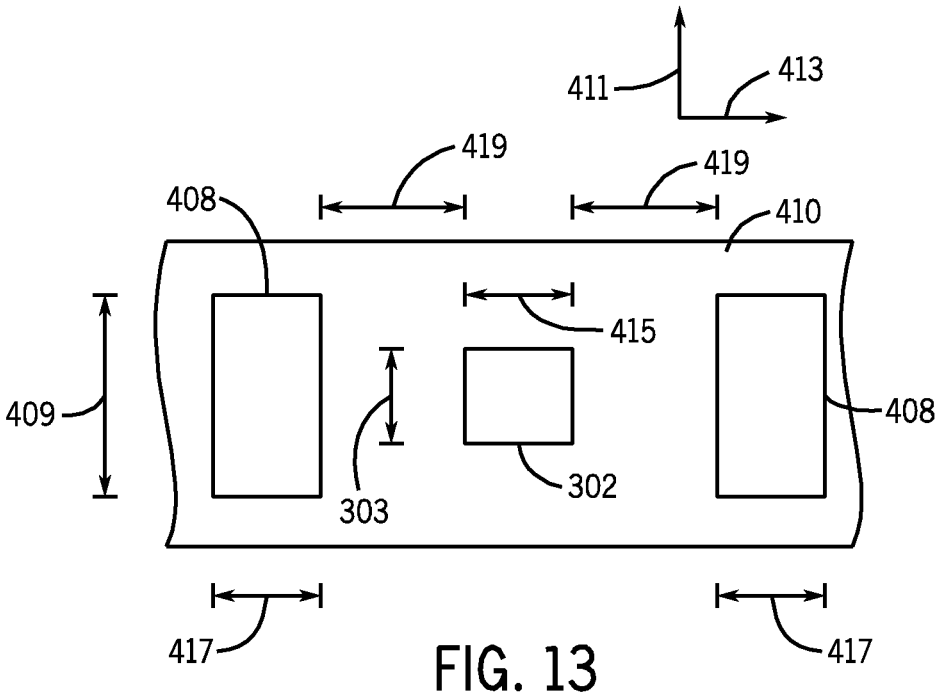
FIG. 13 is a schematic diagram of a front view of a spray device that may be employed in the web moistening system of FIG. 3 in accordance with certain embodiments of the present technique.

FIG. 13 is a schematic diagram of a front view of the nozzle 410 component of the spray device 108. The nozzle 410 depicted in this figure contains a rectangular liquid orifice 302 and rectangular pneumatic orifices 408. Experimentation has determined that rectangular orifices may produce effective spray patterns for web moistening. Furthermore, FIG. 13 shows that the pneumatic orifices 408 are longer than the liquid orifice 302. In particular, pneumatic orifices 408 have a length 409, whereas liquid orifice 302 has a length 303. In certain embodiments, length 409 may be at least 1.1, 1.2, 1.3, 1.4, 1.5, 1.6, 1.7, 1.8, 1.9, 2, 3, 4, 5, or more times length 303. For example, length 409 may be more than approximately 20 percent longer than length 303. Furthermore, liquid orifice 302 may be positioned such that pneumatic orifices 408 extend past opposite ends of liquid orifice 302 along a vertical axis 411. This overlapping, or sandwich, configuration may reduce tails by confining liquid droplets to the plane of the fan-shaped stream. Tails are undesirable components of a spray pattern that are formed when a small number of droplets travel outside of the desired flow pattern. Confining these droplets to the fan-shaped stream may provide a more uniform liquid distribution across the web 102. Alternative embodiments may employ pneumatic orifices 408 that extend past only one end of liquid orifice 302 along the vertical axis 411.

Dimensions of both the liquid orifice 302 and the pneumatic orifices 408 may be varied based on the desired liquid spray configuration. For example, if a greater gas velocity is desired, the size of the pneumatic orifices 408 may be reduced. In addition, larger droplets may be formed by increasing the size of the liquid orifice 302. However, as previously discussed, the disclosed embodiments may maintain the rectangular shape of orifices 302 and 408, where the pneumatic orifices 408 are longer than the liquid orifice 302. Therefore, a width 415 of liquid orifice 302 and a width 417 of pneumatic orifices 408 may be varied to adjust the size of orifices 302 and 408, respectively. In the present embodiment, the width 415 of liquid orifice 302 is substantially similar to the width 417 of pneumatic orifices 408. However, widths 415 and 417 may vary in alternative embodiments. In addition, the length 303 of liquid orifice 302 may be approximately two times the width 415, as illustrated in FIG. 13. Alternatively, the length 303 may be about 1, 1.2, 1.4, 1.6, 1.8, 2, 2.2, 2.4, 2.6, 2.8 or more times the width 415 of liquid orifice 302, for example. Similarly, as illustrated in FIG. 13, the length 409 of pneumatic orifices 408 may be four times the width 417. In alternative embodiments, the length 409 may be about 1, 1.5, 2, 2.5, 3, 3.5, 4, 4.5, 5, 5.5, 6, 6.5 or more times the width 417 of pneumatic orifices 408, for example.

Furthermore, orifice spacing may be varied to alter the frequency and/or amplitude of droplet vacillation, for example. As illustrated, pneumatic orifices 408 are spaced a distance 419 from liquid orifice 302 along lateral axis 413. As presented in FIG. 13, spacing 419 is approximately 1.5 times the width 415 of liquid orifice 302. In alternative embodiments, the spacing 419 may be about 0.5, 1, 1.5, 2, 2.5 or more times the width 415 of liquid orifice 302. Further embodiments may enhance droplet formation by minimizing the spacing around liquid orifice 302, such that spacing 419 approaches zero. By adjusting dimensions of nozzle components, spray patterns may be configured for particular applications.

One advantage of the present embodiment is that the liquid orifice 302 may be larger than the liquid orifice of a hydraulic atomizer. Hydraulic atomizers generally require a small liquid orifice to sufficiently accelerate the liquid linearly and/or rotationally such that it atomizes. In contrast, pneumatic atomizers use gas flow to atomize liquid. Therefore, a larger liquid orifice 302 may be employed. Larger liquid orifices may be less prone to clogging because small particles may simply pass through instead of becoming lodged and obstructing liquid flow. Because the liquid orifice 302 may be able to accommodate particles in the liquid, tap water may be used as the moistening liquid, instead of the more expensive de-ionized water typically utilized in hydraulic atomizers. In addition, the larger liquid orifice 302 may facilitate spraying other liquids, including silicone and lotion, that may induce clogging and/or be too viscous to flow through the smaller orifice of a hydraulic atomizer.

Furthermore, pneumatic atomization may utilize substantially less water than hydraulic atomization, thereby reducing operational costs. Specifically, to achieve proper atomization using a hydraulic system, a high water flow rate may be utilized. For example, a flow rate of approximately 1 liter per hour through each nozzle may be employed to achieve proper droplet formation via hydraulic atomization. However, desired flow rates may be significantly less than 1 liter per hour for proper web moistening. Therefore, a shield may be partially disposed within the spray pattern to block a portion of the liquid from contacting the web 102. For example, if a flow rate of 0.3 liters per hour is desired, the shield may redirect 0.7 liters per hour. Because the redirected water may not be recovered and reused, 0.7 liter per hour of water may be wasted for each nozzle. In contrast, because pneumatic atomization utilizes air flow to achieve proper atomization, liquid flow rates may be decreased without adversely affecting droplet formation. For example, pneumatic atomization may enable the web moistening system 100 to vary flow rates between approximately 0.1 to 3.0, 0.2 to 2.5, or 0.3 to 2.0 liters per hour for each spray device 108. In other words, the web moistening system 100 in the present embodiment may include a flow rate ratio (minimum to maximum) of approximately 1:20.

Moreover, pneumatic atomization may facilitate increased droplet size compared to hydraulic atomization, thereby further reducing water consumption. For example, hydraulic atomizers may produce droplets between approximately 20 to 100 microns in diameter. In contrast, pneumatic atomizers may produce droplets between approximately 100 to 1000, 200 to 800, or 300 to 500 microns in diameter. The larger droplets may experience less evaporation as they travel from the spray device 108 to the web 102. Specifically, for a given quantity of water, larger droplets yield a smaller total surface area than smaller droplets because fewer larger droplets are formed. As appreciated, evaporation rate is dependent on surface area. Therefore, larger droplets may experience less evaporation, thereby reducing the quantity of water emanated from the spray devices 108 to achieve a desired web moisture content. In addition, larger droplets may result in a greater deposition efficiency compared to smaller droplets because the larger droplets may penetrate farther into the web 102. In certain embodiments, deposition efficiency may increase between approximately 20% to 50%. Finally, water consumption may be reduced because a greater percentage of the larger droplets may overcome the web boundary layer. As appreciated, due to high web speeds through the system 100, the web 102 may develop a boundary layer that may redirect the flow of droplets away from the web 102. Due to the greater mass associated with larger droplets, more droplets may overcome this boundary layer and contact the web 102. The combination of the mechanisms described above may decrease water consumption, thereby reducing operating costs.

FIGS. 14-18 show layers 602, 604, 606, 608, 610, 612 and 614 of an exemplary embodiment of the spray device 108. As previously discussed, the spray device 108 may be formed from multiple layers of material. All of the layers, 602 through 614, for one embodiment are depicted in FIG. 14, while FIGS. 15-18 show a top view of the individual layers. As discussed in detail below, gas and liquid enter the spray device 108 along the vertical axis 411 generally perpendicular to layers 602 through 614. The spray device 108 then expels the gas and liquid in a plane defined by a horizontal axis 617 and lateral axis 413, generally in the plane of layers 602 through 614.

Layer 602 is the top layer of the spray device 108. A top view of this layer may be seen in FIG. 15. As illustrated, liquid from the liquid supply 112 may enter the liquid inlet 404 along vertical axis 411. Similarly, gas from the pneumatic supply 110 may enter pneumatic inlets 406 along vertical axis 411. As previously discussed, layer 602 includes bolt holes 402 configured to facilitate securing layers 602 through 614 together with bolts.

Figure 16:
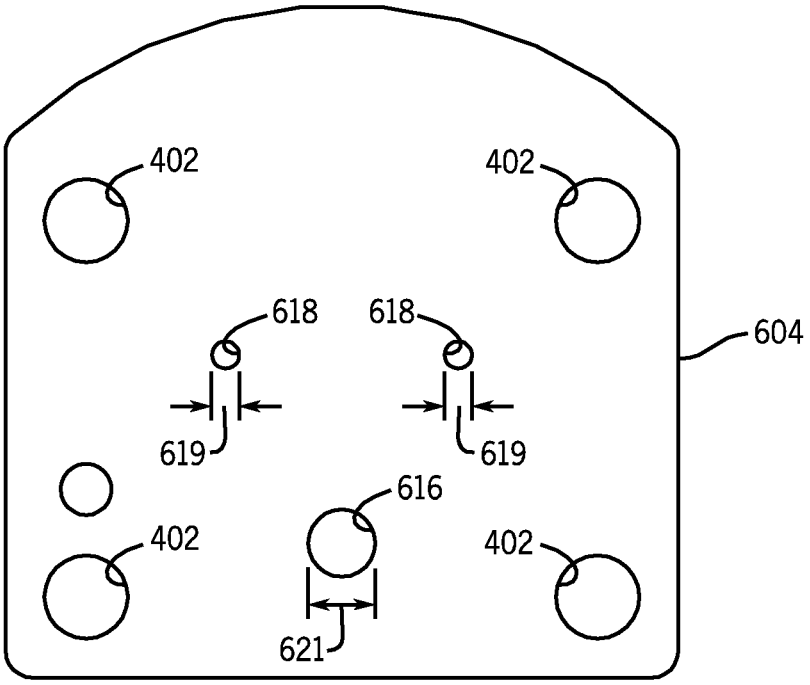
FIG. 16 is a top view of a second layer of the spray device represented in FIG. 14 in accordance with certain embodiments of the present technique.

A top view of the second layer 604 may be seen in FIG. 16. This layer contains a vertical liquid conduit 616 which may facilitate liquid flow from the liquid inlet 404 to the liquid orifice 302. Similarly, two vertical pneumatic conduits 618 are located in layer 604. These conduits enable gas to travel through the spray device to the pneumatic orifices 408. The vertical pneumatic conduits 618 are configured to control gas flow under a given pressure drop. Specifically, smaller conduit size reduces gas consumption under the same pressure drop. As can best be seen in FIGS. 15 and 16, a diameter 619 of the vertical pneumatic conduits 618 is smaller than a diameter 407 of the pneumatic inlets 406. For example, the diameter 407 may be more than approximately 1.5, 2, 2.5, 3, 3.5, 4, or more times the diameter 619. Furthermore, a diameter 405 of the liquid inlet 404 may be substantially similar to or larger than a diameter 621 of the vertical liquid conduit 616. However, the diameter and shape of the vertical conduits 616 and 618 within this layer may be varied in alternative embodiments based on desired flow properties.

Figure 17:
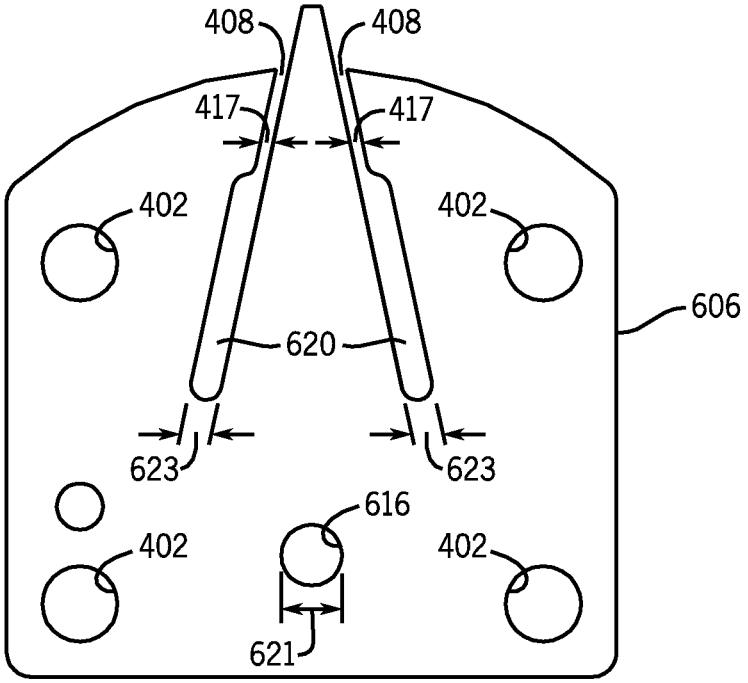
FIG. 17 is a top view of a third layer of the spray device represented in FIG. 14 in accordance with certain embodiments of the present technique.

FIG. 17 depicts a top view of the third layer 606. This layer includes another section of the vertical liquid conduit 616. Layer 606 also contains two horizontal pneumatic conduits 620 which redirect gas from the vertical pneumatic conduits 618 to the pneumatic orifices 408. As can be seen in FIG. 14, an initial width 623 of the horizontal pneumatic conduits 620 is substantially similar to the diameter 619 of the vertical pneumatic conduits 618. However, the horizontal pneumatic conduits 620 narrow as they approach the pneumatic orifices 408. Specifically, width decreases from the initial width 623 to a width 417 at the pneumatic orifices 408. For example, the width 623 may be more than about 1.2, 1.4, 1.6, 1.8, 2, 2.2, 2.4, 2.6, 2.8 or more times the width 417.

Figure 18:
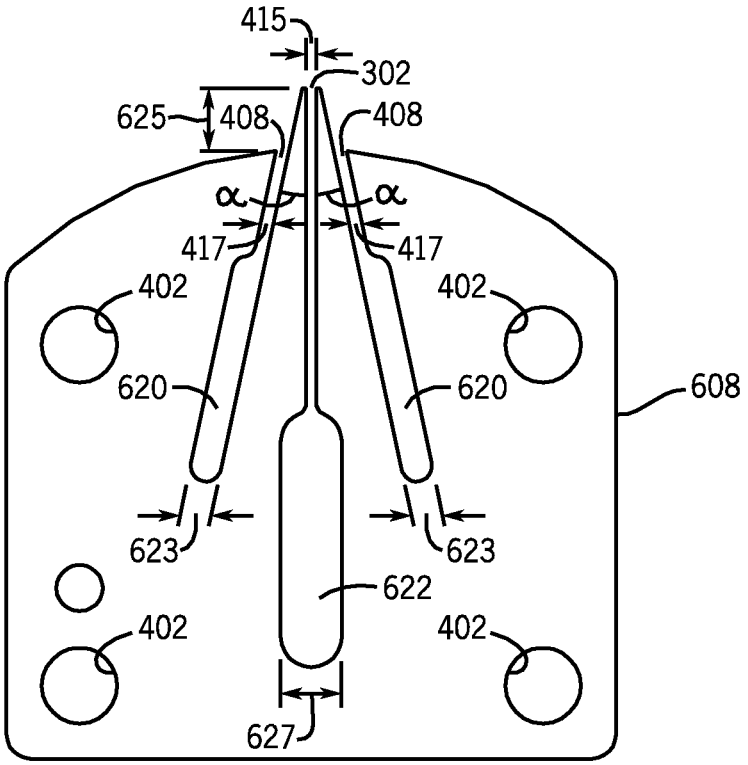
FIG. 18 is a top view of a fourth layer of the spray device represented in FIG. 14 in accordance with certain embodiments of the present technique.

A top view of the fourth layer 608 is shown in FIG. 18. This layer contains the two horizontal pneumatic conduits 620, as seen in layer 606 (FIG. 17). In addition, layer 608 contains a horizontal liquid conduit 622 that transfers liquid from the vertical liquid conduit 616 to the liquid orifice 302. As best seen in FIG. 14, an initial width 627 of the horizontal liquid conduit 622 is substantially the same as the diameter 621 of the vertical liquid conduit 616. Furthermore, the width of the horizontal liquid conduit 622 progressively decreases to correspond to a width 415 of the liquid orifice 302. As with the horizontal pneumatic conduits 620, the configuration of the horizontal liquid conduit 622 affects liquid flow properties.

FIG. 18 also depicts an angle, $\alpha$, between each horizontal pneumatic conduit 620 and the horizontal liquid conduit 622. This angle may be adjusted between approximately 0° and 90°. For example, in certain embodiments, $\alpha$ is about 10°, 20°, 30°, 40°, 50°, 60°, 70° or 80°, or an angle therebetween. As depicted in FIG. 18, $\alpha$ is approximately 10°. Experimentation has determined that an angle $\alpha$ of approximately 30° may be well-suited for certain web moistening applications. Varying a may affect both the configuration of the fan-shaped stream and the ability of the gas streams to dislodge obstructions in the liquid orifice 302.

As previously discussed, liquid orifice 302 may protrude in a downstream direction from the gas flow of the pneumatic orifices 408. As illustrated, liquid orifice 302 is positioned a distance 625 from the face of spray device 108. In certain embodiments, distance 625 may be approximately 0, 1, 2, 3, 4, 5, 6, 7, 8, 9, 10 or more times the width 415 of liquid orifice 302. As described above, the protrusion of liquid orifice 302 is tapered at an angle $\alpha$ and has a generally rectangular shape. Positioning the liquid orifice 302 downstream from the pneumatic orifices 408 may serve to dislodge obstructions in the liquid orifice 302. However, in alternative embodiments, liquid orifice 302 may be positioned substantially flush with the face of spray device 108.

Layer 610, as depicted in FIG. 14, is substantially similar to layer 606, and layer 612 is substantially similar to layer 604. As can be seen in FIG. 14, the top and bottom of the horizontal liquid conduit 622 is formed by layers 606 and 610, respectively. In other words, liquid flowing through the horizontal liquid conduit 622 is confined to a path through layer 608. Therefore, the length 303 of the horizontal liquid conduit 622, and liquid orifice 302, along vertical axis 411 is equal to a thickness 609 of layer 608.

In addition, layers 604 and 612 serve to confine the flow of gas to the horizontal pneumatic conduits 620. Unlike the horizontal liquid conduit 622, the length 409 of horizontal pneumatic conduits 620, and pneumatic orifices 408, along vertical axis 411 is equal to the thickness 609 of layer 608 combined with thicknesses 611 of layers 606 and 610. As a result of this layering, the length 409 of the pneumatic orifices 408 is greater than the length 303 of the liquid orifice 302. Layer 612 serves to provide symmetry to the spray device 108 between layers 604 and 612. In this configuration, layers 604 to 612, as a stack, may be rotated 180 degrees about horizontal axis 617 and sandwiched between layers 602 and 614. Alternative embodiments may omit layer 612 such that layer 614 serves to confine the flow of gas to the horizontal pneumatic conduits 620.

The final layer of the spray device 108 is layer 614. This layer serves as an end cap for both the vertical pneumatic conduits 618 and the vertical liquid conduit 616. By capping these conduits, both gas and liquid are forced to exit their respective orifices. The layered configuration described above may enable the spray devices 108 to be reconfigured for varying droplet sizes and/or spray patterns by replacing individual layers. Furthermore, as appreciated, in addition to the multi-layered assembly described above, other embodiments of the spray device 108 may be constructed using alternative techniques. For example, the spray device 108 may be machined and/or molded from solid blocks of material.

Figure 19:
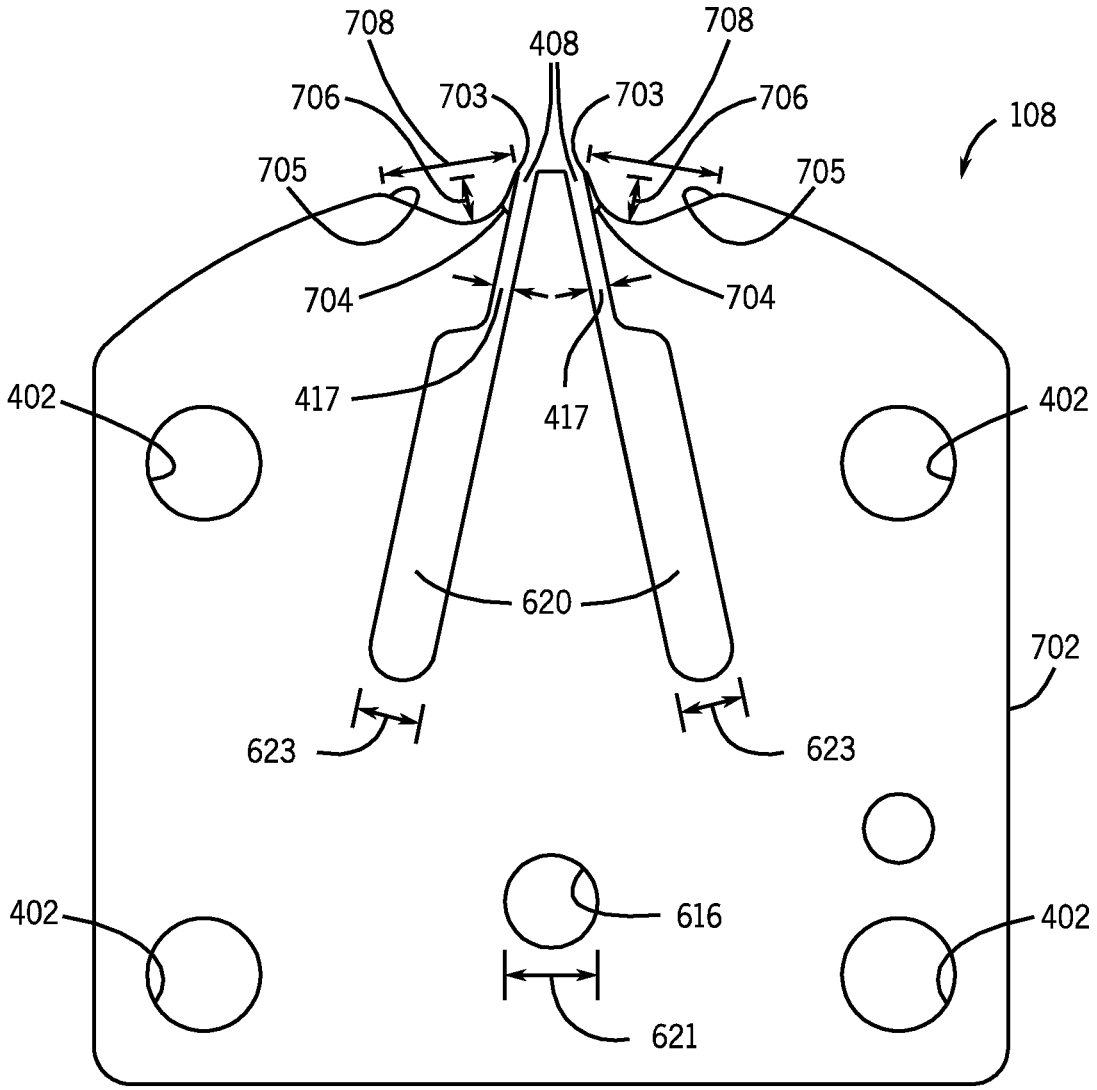
FIG. 19 is a top view of an alternative embodiment of the third layer of the spray device represented in FIG. 14 in accordance with certain embodiments of the present technique.
Figure 20:
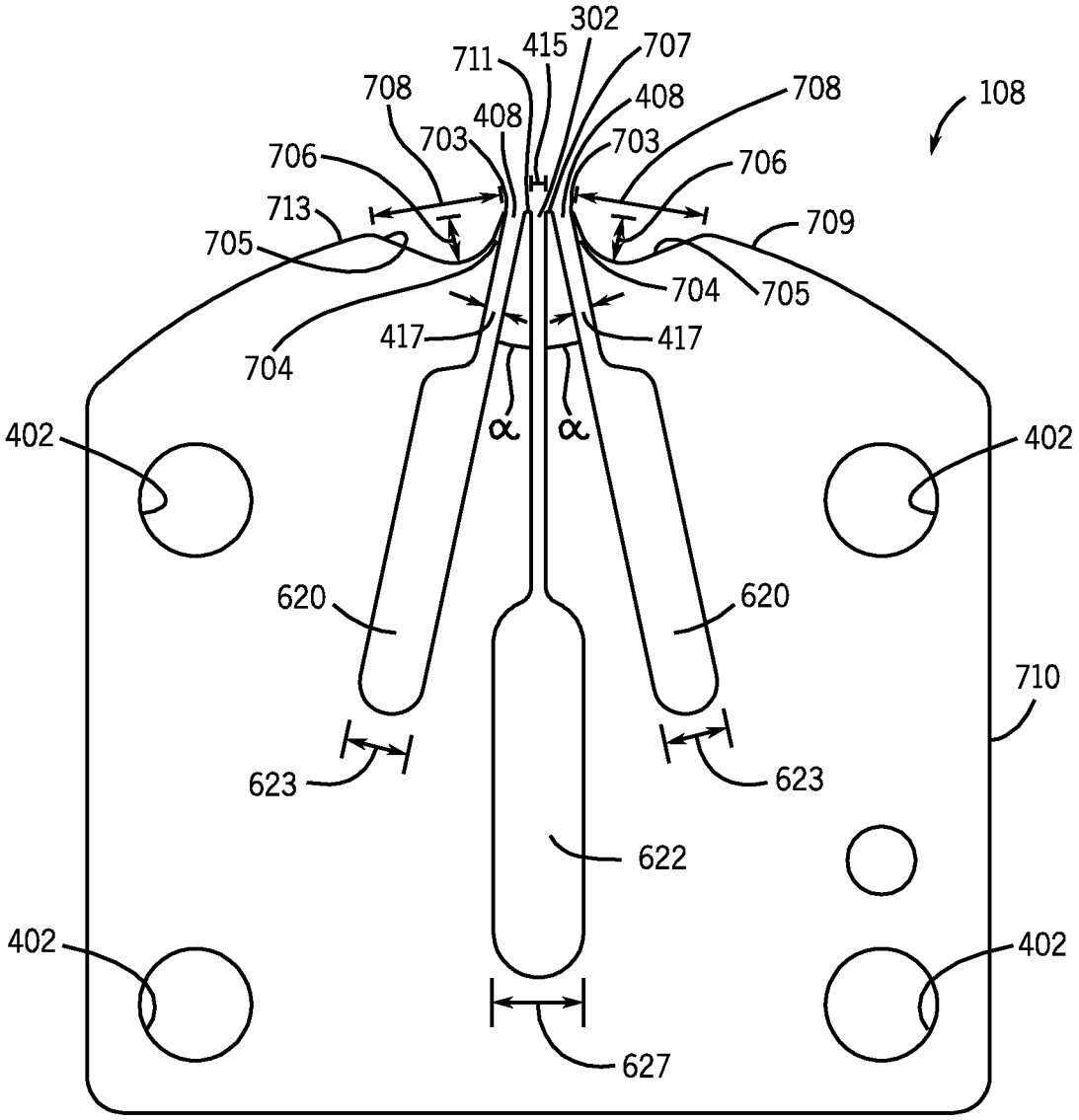
FIG. 20 is a top view of an alternative embodiment of the fourth layer of the spray device represented in FIG. 14 in accordance with certain embodiments of the present technique.
Figure 21:
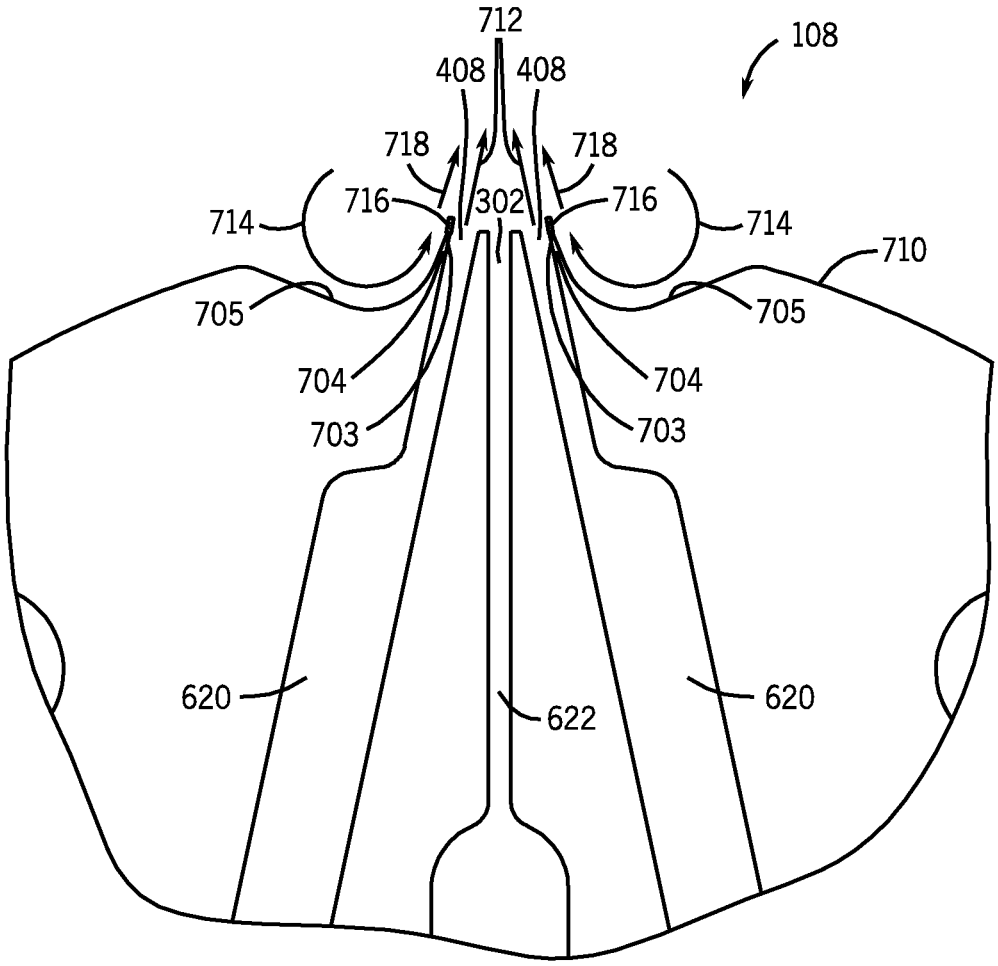
FIG. 21 is a detailed top view of the liquid and pneumatic orifices of the alternative embodiment of the fourth layer of the spray device represented in FIG. 14 in accordance with certain embodiments of the present technique.

FIGS. 19-21 represent an alternative embodiment of spray nozzle 108 that is configured to reduce a buildup of salt and/or other minerals that may accumulate adjacent to pneumatic orifices 408 during operation of the spray device 108. For example, the liquid supply 112 may provide the spray device 108 with "softened" water. Softened water is formed by passing tap water, for example, through a reverse-osmosis filter. However, this process may add small amounts of salt to the water. During operation of the web moistening system 100, liquid droplets from the liquid orifice 302 may impact various regions of the spray device 108, including areas adjacent to pneumatic orifices 408. As these droplets evaporate, salt and/ or other minerals within the water may be deposited within the flow path of the pneumatic orifices 408. Over time, these deposits may accumulate, eventually interfering with gas flow and resulting in a non-uniform spray pattern. The alternative embodiment described below is configured to reduce the buildup of salt and/or other minerals within the flow path of the pneumatic orifices 408.

FIG. 19 is a top view of an alternative embodiment of a third layer 702 of the spray device 108. Layer 702 may replace layer 606 of the embodiment described above with regard to FIGS. 14-18. Layer 702 includes certain features configured to reduce a buildup of salt and/or other minerals that may accumulate within the flow path of pneumatic orifices 408 during operation of the spray device 108. Specifically, layer 702 includes a point 703 forming an angle 704 and a curved portion 705 having a depth 706 and a width 708. As discussed in detail below, the curved portion 705 is configured to direct a flow of gas toward the point 703 such that water droplets impact the point 703 and/or are redirected away from the spray device 108. Any salt and/or mineral buildup on the point 703 may be dislodged by gas flow and/or vibration of the spray device 108. In this manner, salt and/or mineral buildup within the flow path of the pneumatic orifices 408 may be reduced.

The angle 704 of the point 703 relative to the horizontal pneumatic conduits 620 is configured to provide a reduced surface area for the accumulation of salt and/or other minerals. As appreciated, deposits may be extricated from a smaller surface area with a reduced force. Therefore, the sharper the point 703, the more likely a given force may dislodge the mineral buildup. Consequently, force provided by gas flow from the horizontal pneumatic conduits 620 may remove salt and/or other minerals from the point 703 due to the reduced surface area. For example, in certain embodiments, the angle 704 may be less than approximately 30°. Alternative embodiments may include angles 704 from 0° to 45°, 2° to 40°, 4° to 35°, 6° to 30°, 8° to 25°, 100 to 20°, and 12° to 15°, for example. Further embodiments may include angles 704 less than about 30°, 25°, 20°, 15°, 12°, 100, 8°, 6°, 4°, or 2°.

Furthermore, the curved portion 705 is configured to redirect a flow of gas toward the point 703 and/or in a direction away from the spray device 108 (i.e., in the downstream direction). Specifically, the depth 706 of the curved portion 705 may be approximately two times the width 417 of the pneumatic orifices 408. Further embodiments may include a depth 706 of greater than approximately 0, 1, 2, 3, 4, 5, 6, 7, 8, 9 or more times the width 417. The width 708 of the curved portion 705 may be approximately seven times the width 417 of the pneumatic orifices 408. Further embodiments may include a width 708 of greater than approximately 0, 2, 4, 6, 8, 10, 12, 14 or more times the width 417.

FIG. 20 is a top view of an alternative embodiment of a fourth layer 710 of the spray device 108. Layer 710 may replace layer 608 of the embodiment described above with regard to FIGS. 14-18. As illustrated, the point 703 and the curve portion 705 are substantially similar to the point 703 and curved portion 705 of layer 702. Therefore, a thickness of the point 703 and the curved portion 705 is at least partially defined by the thickness of layers 702 and 710. In alternative embodiments, the angle 704 of the point 703 and/or the depth 706 and/or the width 708 of the curved portion 705 may vary between layers 702 and 710.

As illustrated, layer 710 includes a first pneumatic passage 620 extending directly along the liquid passage 622 to a first pneumatic orifice 408 disposed between a first surface 707 and a second surface 709. The second surface 709 includes the point 703 and the curved portion 705 configured to reduce salt and/or other mineral buildup along the flow path of the first pneumatic orifice 408. Specifically, the curved portion 705 forms a C-shape, U-shape, concave recess or curved recess within the second surface 709 and extends to the first pneumatic passage 620. In other words, the curved portion 705 is directly adjacent to the first pneumatic orifice 408. The interface between the curved portion 705 and the first pneumatic passage 620 forms the point 703. The point 703 may also be considered a tip, peripheral edge, peak, protruding tip, or angled protrusion of the second surface 709 with respect to the first pneumatic passage 620. As illustrated, the point 703 is positioned along the first pneumatic passage 620, directly adjacent to the first pneumatic orifice 408. Layer 710 also includes a liquid passage 622 extending to a liquid orifice 302 disposed between the first surface 707 and a third surface 711. Furthermore, layer 710 includes a second pneumatic passage 620 extending directly along the liquid passage 622 to a second pneumatic orifice 408 disposed between the third surface 711 and a fourth surface 713. The fourth surface 713 includes the point 703 and the curved portion 705 configured to reduce salt and/or other mineral buildup along the second pneumatic orifice 408.

In certain configurations, an alternative embodiment of the fifth layer may be included. The alternative fifth layer may be substantially similar to layer 702. Layers 702, 710 and the alternative fifth layer may be sandwiched between layers 604 and 612 of the spray device 108 presented in FIG. 14. Thus, the thickness of the expansion portion 703 may be defined by the combined thicknesses of the layers 702, 710 and the fifth layer. In this configuration, the alternative embodiment may function in a similar manner to the previously described embodiment, while limiting buildup of salt and/or other minerals in the flow path of the pneumatic orifices 408.

FIG. 21 is a detailed top view of liquid orifice 302 and pneumatic orifices 408 of the alternative embodiment of the fourth layer 710, showing the flow path of gas (e.g., air) around the pneumatic orifices 408. As previously described, the point 703 and the curved portion 705 are configured to reduce the buildup of salt and/or other minerals that may interfere with the flow of gas from pneumatic orifices 408. As illustrated, gas emitted from pneumatic orifices 408 may flow in a downstream direction 712. As appreciated, the flowing gas may establish a region of low pressure, drawing surrounding air toward the flow. The curved portion 705 is configured to direct the air flow toward the point 703. Specifically, the curved portion 705 converges with an inner surface of the horizontal pneumatic conduit 620 in the downstream direction, thereby forming the point 703 and directing air along the surface of the curved portion 705 in a direction 714. Water droplets may be captured by the air flow and directed toward the point 703. A portion of the water droplets may adhere to the point 703, while other droplets remain in the air flow. Over time, the droplets that adhere to the point 703 may evaporate, causing an accumulation of salt and/or other minerals on the point 703, as represented by buildup 716. However, due to the small surface area associated with the point 703, air flow from the surface of the curved portion 705 and/or gas flow from the pneumatic orifices 408 may dislodge the buildup 716 from the point 703. Specifically, the flows may apply a shear force along the point 703 in a direction away from the spray device 108. As previously discussed, the small surface area of the point 703 increases the likelihood that a given flow pressure may dislodge the buildup 716. Therefore, the flows may remove the buildup 716 from the point 703 and carry it in a downstream direction 712. In addition, the spray device 108 may vibrate during operation, providing an additional force to extricate the buildup 716. Therefore, the quantity of salt and/or other minerals deposited adjacent to the pneumatic orifices 408 may be minimized.

In addition, buildup 716 on the point 703 may be further reduced because a portion of the water droplets captured by the air flow along the surface of the curved portion 705 may remain in the air flow. As illustrated, water droplets captured by air flowing in direction 714 may bypass the point 703 and flow in a direction 718. For example, more than 10%, 20%, 30%, 40%, 50%, 60%, 70%, or 80% of the water droplets may remain in the flow. Because some of the water droplets do not adhere to the point 703, less buildup 716 may be formed. In certain embodiments, the direction 718 may be substantially similar to the downstream direction 712 of the gas flow from the pneumatic orifices 408. In this configuration, the air flow from the curved portion 705 may combine with the gas flow from the pneumatic orifices 408. In addition, a portion of the air and/or gas flow may return to the curved portion 705, thus establishing a recirculating flow in direction 714. The combination of directing water droplets away from the spray device 108 and the small surface area of the point 703 may reduce salt and/or mineral buildup that may interfere with gas flow from the pneumatic orifices 408, thereby maintaining a substantially uniform spray pattern 304.

Figure 22:
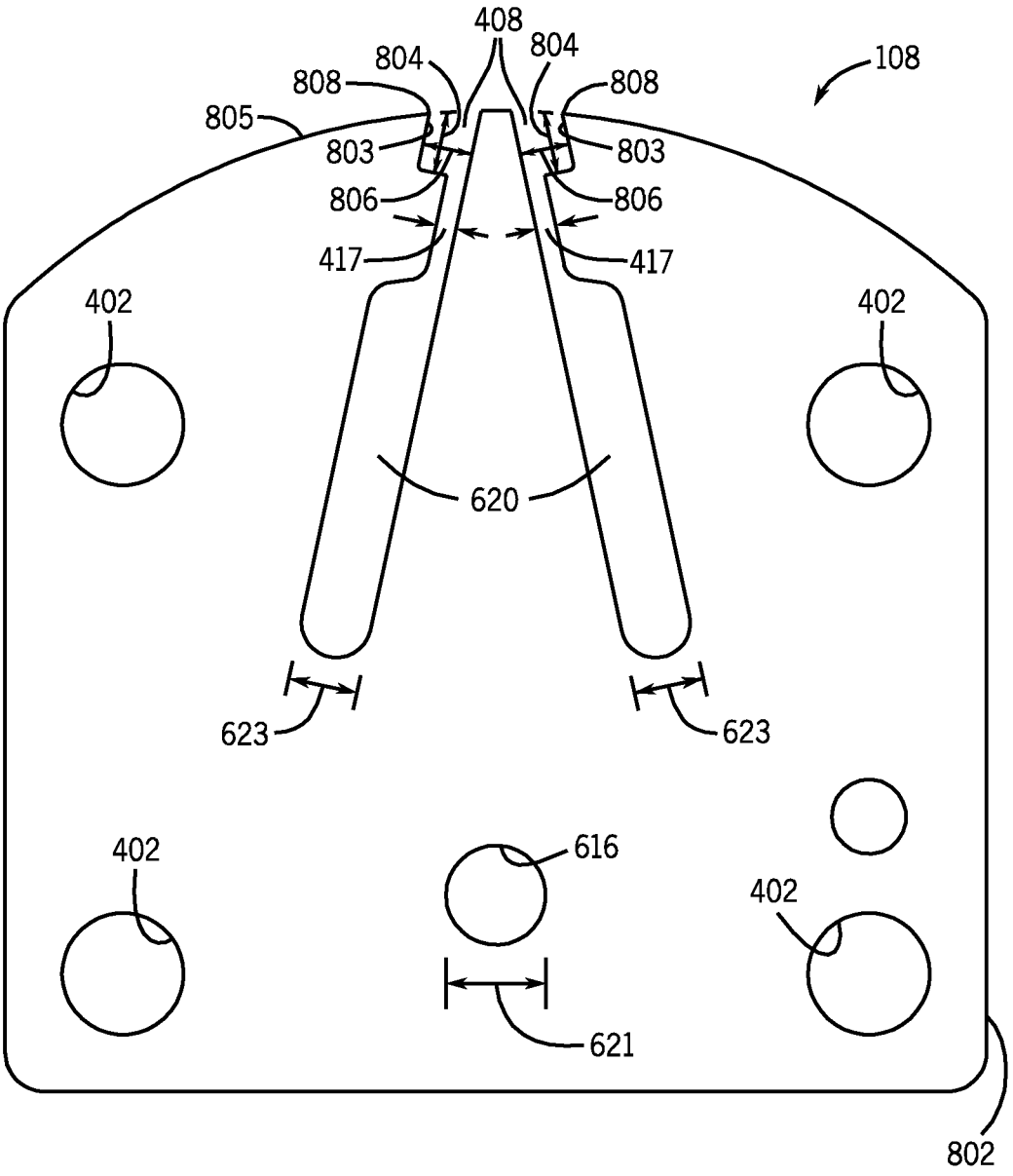
FIG. 22 is a top view of a second alternative embodiment of the third layer of the spray device represented in FIG. 14 in accordance with certain embodiments of the present technique.
Figure 23:
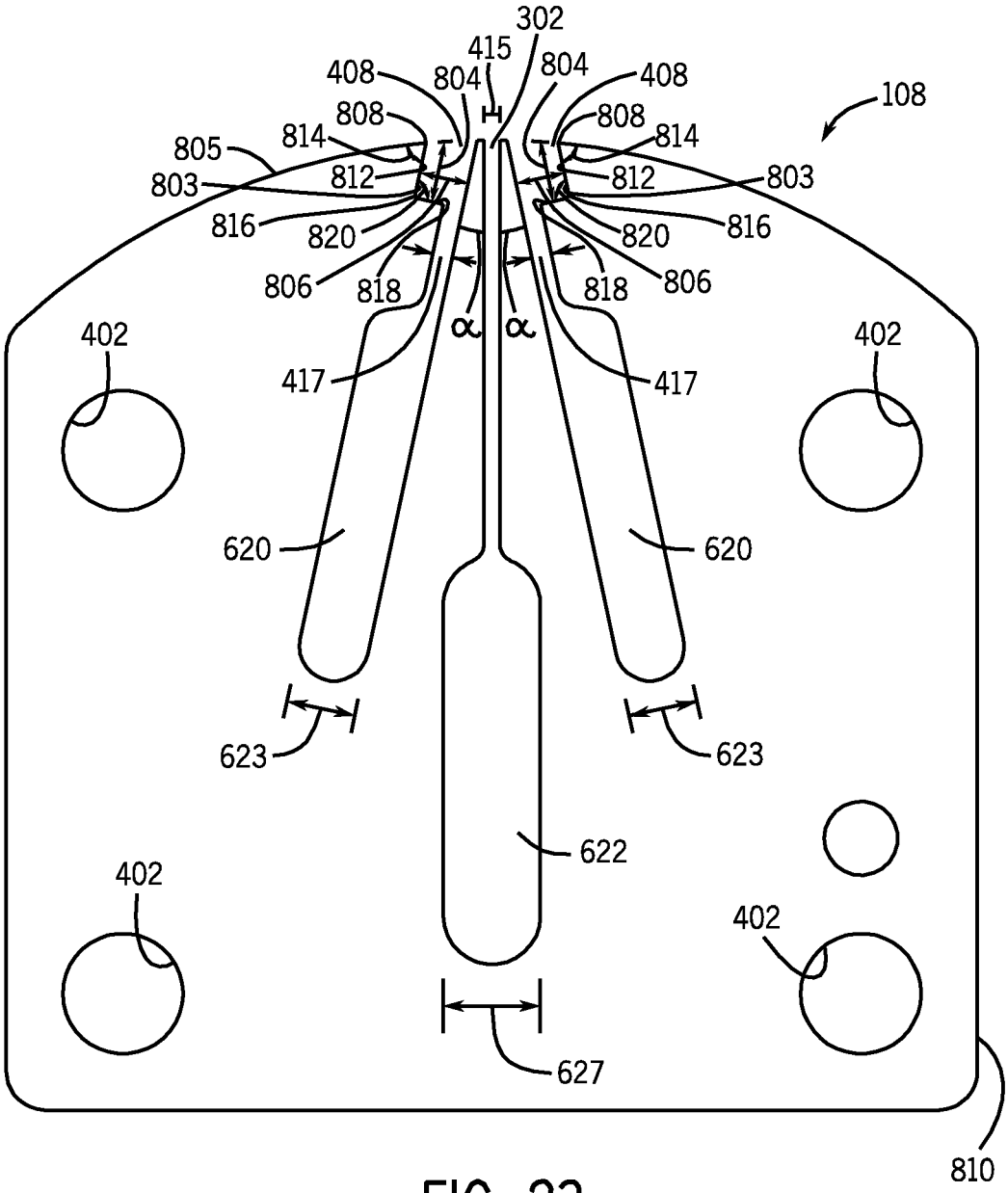
FIG. 23 is a top view of a second alternative embodiment of the fourth layer of the spray device represented in FIG. 14 in accordance with certain embodiments of the present technique.

FIGS. 22-24 represent an second alternative embodiment of spray nozzle 108 that is configured to reduce a buildup of salt and/or other minerals that may accumulate adjacent to pneumatic orifices 408 during operation of the spray device 108. FIG. 22 is a top view of an alternative embodiment of a third layer 802 of the spray device 108. Layer 802 may replace layer 606 of the embodiment described above with regard to FIGS. 14-18. Layer 802 includes certain features configured to reduce a buildup of salt and/or other minerals that may form adjacent to pneumatic orifices 408 during operation of the spray device 108. Specifically, layer 802 includes an expansion portion 803 within each horizontal pneumatic conduit 620, forming recesses within an exit surface 805. The expansion portions 803 are configured to induce recirculation within the recesses and/or adjacent to the exit surface 805. As discussed in detail below, recirculation within the expansion portion 803 may deposit salt and/or other minerals outside of the flow path of gas emitted from horizontal pneumatic conduits 620. In addition, recirculation adjacent to the exit surface 805 may deposit salt and/or other minerals on a point or angled tip of the expansion portion 803 having a small surface area. Air flow and/or vibrations of the spray device 108 may dislodge the deposits from the point, thereby reducing buildup within the flow path of the pneumatic orifices 408.

As illustrated, the expansion portion 803 has a depth 804 and a width 806 configured to induce recirculation within the expansion portion 803. In the present embodiment, the depth 804 is approximately 3 times the width 417 of the pneumatic orifice 408. Alternative embodiments may include a depth 804 of greater than approximately 0, 1, 2, 3, 4, 5, 6, 7, 8, 9 or more times the width 417. Furthermore, the width 806 is approximately 2 times the width 417 of the pneumatic orifice 408. Alternative embodiments may include a width 806 of greater than approximately 0, 1, 2, 3, 4, 5, 6, 7, 8, 9 or more times the width 417.

The illustrated embodiment includes a substantially rectangular expansion portion 803. Further embodiments may include alternative configurations such as substantially circular, triangular, elliptical or polygonal, among other configurations. In addition, the expansion portion 803 forms a point 808 along the exit surface 805 of the spray device 108. The point 808 is configured to provide a reduced surface area for the accumulation of salt and/or other minerals. As appreciated, deposits may be extricated from a smaller surface area with a reduced force. Therefore, the sharper the point 808, the more likely a given force may dislodge the mineral buildup. Consequently, force provided by gas flow from the horizontal pneumatic conduits 620 may remove salt and/or other minerals from the point 808 due to the reduced surface area.

FIG. 23 is a top view of an alternative embodiment of a fourth layer 810 of the spray device 108. Layer 810 may replace layer 608 of the embodiment described above with regard to FIGS. 14-18. As illustrated, the depth 804 and the width 806 are substantially similar to the depth 804 and the width 806 of layer 802. In addition, the thickness of the expansion portion 803 is at least partially defined by the thickness of layers 802 and 810. In alternative embodiments, the depth 804, the width 806 and/or the geometric configuration of the expansion portion 803 may vary between layers 802 and 810.

The point 808 represents an exterior angled tip at an interface of the exit surface 805 and an interior wall 812 of the expansion portion 803. As illustrated, the interior wall 812 extends toward the point 808 in a direction substantially parallel to the horizontal pneumatic conduit 620. The intersection between the interior wall 812 and the exit surface 805 forms the point 808 which may also be considered an angled projection, external peak, or angled tip. As appreciated, an angle 814 of the point 808 may be varied by adjusting the geometric configuration of the expansion portion 803. Furthermore, an interior corner 816 is defined by an interior angle between an interior ledge or step 818 and the interior wall 812. As illustrated, the ledge 818 extends substantially perpendicularly outward from the horizontal pneumatic conduit 620, i.e., away from the horizontal liquid conduit 622. The interior wall 812 extends between the point 808 and the ledge 818, forming the interior corner 816. As appreciated, an angle 820 of the corner 816 may be varied by adjusting a length of the ledge 818 and/or the wall 812.

In certain configurations, an alternative embodiment of the fifth layer may be included. The alternative fifth layer may be substantially similar to layer 802. Layers 802, 810 and the alternative fifth layer may be sandwiched between layers 604 and 612 of the spray device 108 presented in FIG. 14. Thus, the thickness of the expansion portion 803 may be defined by the combined thicknesses of the layers 802, 810 and the fifth layer. In this configuration, the alternative embodiment may function in a similar manner to the previously described embodiment, while limiting buildup of salt and/or other minerals in the flow path of the pneumatic orifices 408.

FIG. 24 is a detailed top view of liquid orifice 302 and pneumatic orifices 408 of the alternative embodiment of the fourth layer 810, showing the flow path of gas (e.g., air) around the pneumatic orifices 408. As previously described, expansion portion 803 is configured to reduce the buildup of salt and/or other minerals that may interfere with the flow of gas from pneumatic orifices 408. As illustrated, gas emitted from pneumatic orifices 408 may flow in a downstream direction 821. As appreciated, the flowing gas may establish a region of low pressure, drawing surrounding air toward the flow. Specifically, gas from the pneumatic orifices 408 and/or surrounding air may recirculate in a direction 822. Water droplets may be captured by the air flow and directed toward the point 808. A portion of the water droplets may adhere to the point 808, while other droplets remain in the air flow. Over time, the droplets that adhere to the point 808 may evaporate, causing an accumulation of salt and/or other minerals on the point 808, as represented by buildup 824. However, due to the small surface area associated with the point 808, recirculating air flow along direction 822 and/or gas flow from the pneumatic orifices 408 may dislodge the buildup 824 from the point 808. Specifically, the flows may apply a shear force along the point 808 in a direction away from the spray device 108. As previously discussed, the small surface area of the point 808 increases the likelihood that a given flow pressure may dislodge the buildup 824. Therefore, the flows may remove the buildup 824 from the point 808 and carry it in a downstream direction 821. In addition, the spray device 108 may vibrate during operation, providing an additional force to extricate the buildup 824. Therefore, the quantity of salt and/or other minerals deposited adjacent to the pneumatic orifices 408 may be minimized. Furthermore, the buildup 824 on the point 808 may be substantially outside of the flow path of gas emitted from the horizontal pneumatic conduits 620. Consequently, flow conditions may be generally uniform over extended use of the spray device 108.

In addition, buildup 824 on the point 808 may be further reduced because a portion of the water droplets captured by the recirculating air may remain in the air flow. As illustrated, water droplets captured by air flowing in direction 822 may bypass the point 808 and flow in a direction 826. For example, more than 10%, 20%, 30%, 40%, 50%, 60%, 70%, or 80% of the water droplets may remain in the flow. Because some of the water droplets do not adhere to the point 808, less buildup 824 may be formed. In certain embodiments, the direction 826 may be substantially similar to the downstream direction 821 of the gas flow from the pneumatic orifices 408. In this configuration, the recirculating air flow may combine with the gas from the pneumatic orifices 408. In addition, a portion of the air and/or gas flow may return to the exit surface 805, thus establishing the recirculating flow in direction 822. Further embodiments may include a curved recess in the exit surface 805 adjacent to the expansion portion 803 and configured to direct the air flow toward the point 808. The combination of directing water droplets away from the spray device 108 and the small surface area of the point 808 may reduce salt and/or mineral buildup that may interfere with gas flow from pneumatic orifices 408, thereby maintaining a substantially uniform spray pattern 304.

It is believed that a second recirculation zone may be formed within the expansion portion 803. Specifically, a portion of the gas flowing through the horizontal pneumatic conduits 620 may flow in a direction 828 prior to exiting the pneumatic orifices 408. Water droplets may be captured within the recirculating flow and deposited in the interior corner 816 of the expansion portion 803. As the water evaporates, a buildup 830 may be formed within the corner 816. As illustrated, the buildup 830 may be substantially outside of the flow path of gas emitted from the horizontal pneumatic conduits 620. In this manner, the buildup 830 may not interfere with the gas flow from pneumatic orifices 408. Over time, the buildup 830 may expand as additional salt and/or other minerals are deposited in the corner 816. However, once the buildup 830 reaches a critical size, it may become dislodged by the gas flow from the horizontal pneumatic conduits 620. Therefore, the size of buildup 830 may be limited to prevent interference with the gas flow. The combination of features described above may reduce salt and/or mineral deposits within and/or surrounding pneumatic orifices 408, thereby maintaining a substantially uniform spray pattern 304.

FIG. 25 is a top view of a third alternative embodiment of a fourth layer 902 of the spray device 108. Layer 902 may replace layer 608 of the embodiment described above with regard to FIGS. 14-18. As illustrated, layer 902 includes a curved portion 904 similar to the curved portion 705 described above with regard to FIGS. 19-21. The curved portion 904 is configured to direct a flow of gas toward a point 905 such that water droplets impact the point 905 and/or are redirected away from the spray device 108. Any salt and/or mineral buildup on the point 905 may be dislodged by gas flow and/or vibration of the spray device 108. In this manner, salt and/or mineral buildup within the flow path of the pneumatic orifices 408 may be reduced. In addition, layer 902 includes an expansion portion 906 within each horizontal pneumatic conduit 620. The expansion portions 906 are configured to induce recirculation within the recesses and/or adjacent to an exit surface 908. As previously discussed, recirculation within the expansion portion 906 may deposit salt and/or other minerals outside of the flow path of gas emitted from horizontal pneumatic conduits 620. In contrast to the rectangular expansion portions 803 described above with regard to FIGS. 22-24, the expansion portions 906 of layer 902 form a curved shape. This configuration may provide enhanced reduction of deposits adjacent to the pneumatic orifices 408. In addition, the combination of the curved portions 904 and the expansion portions 906 may serve to reduce mineral deposits to a greater extent than either feature alone. Therefore, the present embodiment may enable the spray device 108 to maintain a substantially uniform spray pattern 304.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system for supplying liquid to a pneumatic atomizing web moistener, comprising:

a manifold comprising an air tube extending through the manifold from an air inlet to a plurality of air outlets, and a liquid tube extending through the manifold from a liquid inlet to a plurality of liquid outlets, wherein the air tube is disposed in a nested arrangement circumferentially about the liquid tube along an axis of the liquid tube, the air tube and the liquid tube each have a rectangular cross-section, and the liquid tube is mounted in an interior corner of the air tube; wherein the liquid tube contacts two walls of the interior corner of the air tube, and a plurality of nozzles coupled to the manifold, wherein each nozzle is fluidly coupled to the air tube via one air outlet of the plurality of air outlets, and each nozzle is fluidly coupled to the liquid tube via one liquid outlet of the plurality of liquid outlets.

2. The system of claim 1, wherein the air tube forms an outer casing of the manifold.

3. The system of claim 1, wherein the air tube is configured to pass a compressed air flow along an exterior of the liquid tube, and the compressed air flow is configured to heat the exterior of the liquid tube to reduce condensation along the exterior of the liquid tube.

4. The system of claim 1, wherein the nested arrangement is configured to reduce condensation and dripping of liquid from the liquid tube onto a target object receiving a spray of the liquid.

5. A system for supplying liquid to a pneumatic atomizing web moistener comprising:

a manifold comprising an air tube extending through the manifold from an air inlet to a plurality of air outlets in a top wall of the air tube, and a liquid tube extending through the manifold from a liquid inlet to a plurality of liquid outlets in a top wall of the liquid tube, wherein the air outlets establish an air flow path perpendicular to an axis of the manifold, the liquid outlets establish a liquid flow path perpendicular to the axis of the manifold and non-coaxial with the air flow path, the air tube and the liquid tube extend along the axis of the manifold, the air tube and the liquid tube each have a rectangular cross-section, and the air tube circumscribes the liquid tube wherein an outer surface of the top wall of the liquid tube is in contact with an inner surface of the top wall of the air tube and the liquid tube contacts two walls in an interior corner of the air tube; and a plurality of nozzles coupled to the manifold, wherein each nozzle is fluidly coupled to the air tube via one air outlet of the plurality of air outlets, and each nozzle is fluidly coupled to the liquid tube via one liquid outlet of the plurality of liquid outlets.

6. The system of claim 5, wherein the air tube is configured to collect moisture from the liquid tube.

7. The system of claim 5, wherein the air tube forms an outer casing of the manifold.

8. The system of claim 5, wherein the air tube is configured to pass a compressed air flow along an exterior of the liquid tube, and the compressed air flow is configured to heat the exterior of the liquid tube to reduce condensation along the exterior of the liquid tube.

* * * * *